US009685045B2

(12) United States Patent
Gomez

(10) Patent No.: US 9,685,045 B2
(45) Date of Patent: Jun. 20, 2017

(54) COMPUTERIZED GAME MANAGEMENT SYSTEMS AND METHODS

(71) Applicant: Christian Gomez, Miami Beach, FL (US)

(72) Inventor: Christian Gomez, Miami Beach, FL (US)

( * ) Notice: Subject to any disclaimer, the term of this patent is extended or adjusted under 35 U.S.C. 154(b) by 0 days.

(21) Appl. No.: 14/529,042

(22) Filed: Oct. 30, 2014

(65) Prior Publication Data

US 2016/0125700 A1 May 5, 2016

(51) Int. Cl.
*G07F 17/32* (2006.01)

(52) U.S. Cl.
CPC ..... *G07F 17/3293* (2013.01); *G07F 17/3276* (2013.01)

(58) Field of Classification Search
CPC ..... A63F 3/00157
See application file for complete search history.

(56) References Cited

U.S. PATENT DOCUMENTS

| | | | | |
|---|---|---|---|---|
| 7,104,542 | B2 | 9/2006 | Peterson | |
| 7,207,563 | B2 | 4/2007 | Samberg | |
| 2005/0173862 | A1 | 8/2005 | Orenstein | |
| 2007/0037623 | A1 | 2/2007 | Romik | |
| 2008/0248851 | A1* | 10/2008 | Bloom | 463/16 |
| 2008/0318651 | A1* | 12/2008 | Gross et al. | 463/13 |
| 2009/0191934 | A1 | 7/2009 | Larson | |
| 2010/0216532 | A1* | 8/2010 | Halverson | 463/11 |
| 2011/0124397 | A1 | 5/2011 | Gingher | |
| 2012/0264496 | A1 | 10/2012 | Behrman et al. | |
| 2013/0157739 | A1* | 6/2013 | Suttle et al. | 463/13 |
| 2014/0100011 | A1* | 4/2014 | Gingher | G07F 17/32 463/9 |

FOREIGN PATENT DOCUMENTS

| | | | |
|---|---|---|---|
| EP | 1592486 | A1 | 11/2005 |
| EP | 1687781 | A2 | 8/2006 |
| EP | 1937377 | A2 | 7/2008 |

* cited by examiner

*Primary Examiner* — Jay Liddle
*Assistant Examiner* — Alex F. R. P. Rada, II
(74) *Attorney, Agent, or Firm* — Foley & Lardner LLP

(57) ABSTRACT

A computerized card game management system includes a communications interface, a winning percent module, a dealer module, and a game play module. The communications interface is configured to receive data inputs from client devices. The winning percent module is configured to generate a first set of winning percentages defining each player's likelihood of winning each hand of the play cycle during the first segment. The dealer module is configured to select, for each hand of the play cycle, a set of hole cards to be dealt to each player during the first segment. The dealer module selects the set of hole cards based on each player's likelihood of winning the hand as defined by the first set of winning percentages. The game play module is configured to generate a graphical user interface for each player and to provide the graphical user interfaces to the plurality of client devices.

17 Claims, 22 Drawing Sheets

Point scale for chips betted

| | | | | |
|---|---|---|---|---|
| 1 chip = .1 point | 2 chips = .2 points | 3 chips = .3 points | 4 chips = .4 points | 5 chips = .5 points |
| 6 chips = .6 points | 7 chips = .7 points | 8 chips = .8 points | 9 chips = .9 points | 10 chips = 1 point |

| Highest % Hand | Hand 1 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| * | P1 | 21% | No | Call | 1 | -1 | 2 | 0.2 | -0.2 | 48% | No | Call | 1 | -1 | 2 | 0.2 | -0.2 |
| | P2 | 28% | Yes | Call | 0 | -1 | 2 | 0.2 | -0.2 | 52% | Yes | Call | 0 | -1 | 2 | 0.2 | -0.2 |
| | P3 | 15% | No | Fold | -- | -- | -- | -- | | -- | -- | -- | -- | -- | -- | -- | |
| | P4 | 21% | No | Fold | -- | -- | -- | -- | | -- | -- | -- | -- | -- | -- | -- | |
| | P5 | 15% | No | Fold | -- | -- | -- | -- | | -- | -- | -- | -- | -- | -- | -- | |
| | Total | 100% | | | | | | | | | | | | | | | |

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points |
|---|---|---|---|---|---|---|---|---|---|---|---|---|---|---|---|---|---|
| 30% | No | Call | 1 | -1 | 2 | 0.2 | -0.2 | 100% | Yes | Call | 0 | -1 | 2 | 0.2 | -0.2 | * | **3.8** |
| 70% | Yes | Call | 0 | -1 | 2 | 0.2 | -0.2 | * | No | Call | 1 | -1 | 2 | 0.2 | -0.2 | 0 | **-4.8** |
| -- | -- | -- | -- | -- | -- | -- | | -- | -- | -- | -- | -- | -- | -- | | 0 | |
| -- | -- | -- | -- | -- | -- | -- | | -- | -- | -- | -- | -- | -- | -- | | 0 | |
| -- | -- | -- | -- | -- | -- | -- | | -- | -- | -- | -- | -- | -- | -- | | 0 | |
| | | | | | | | | | | | | | | | | | |

FIG. 5

| | |
|---|---|
| Round 1 | 18.5 |
| Round 2 | 9.6 |
| Round 3 | 22.0 |
| Total Play Cycle | 50.1 |

| | |
|---|---|
| Total PC 1: | 50.1 |
| Total PC N: | 18.5 |
| Total PC N: | 18.5 |
| Total PC 18: | 18.5 |
| Total AVG: | 321 |
| Score: | 321 |

Pre-flop percentages for play cycle 1

| | Hand 1 | Hand 2 | Hand 3 | Hand 4 | Hand 5 | Total | Rest of Hands |
|---|---|---|---|---|---|---|---|
| Player 1 | 21% | 2% | 60% | 10% | 7% | 100% | X% |
| Player 2 | 28% | 6% | 7% | 21% | 38% | 100% | X% |
| Player 3 | 15% | 24% | 15% | 39% | 7% | 100% | X% |
| Player 4 | 21% | 58% | 11% | 5% | 5% | 100% | X% |
| Player 5 | 15% | 10% | 7% | 25% | 43% | 100% | X% |
| Total | 100% | 100% | 100% | 100% | 100% | 100% | X% |

Post-flop hand with highest percentage per hand

| | Hand 1 | Hand 2 | Hand 3 | Hand 4 | Hand 5 | Rest of Hands | Total |
|---|---|---|---|---|---|---|---|
| Player 1 | 100% | 4th | 2nd | 5th | 3rd | X% | 480% |
| Player 2 | 3rd | 2nd | 100% | 4th | 5th | X% | 480% |
| Player 3 | 4th | 100% | 5th | 3rd | 2nd | X% | 480% |
| Player 4 | 2nd | 5th | 3rd | 100% | 4th | X% | 480% |
| Player 5 | 5th | 3rd | 4th | 2nd | 100% | X% | 480% |
| Total | 100% | 100% | 100% | 100% | 100% | XX% | XXX% |

FIG. 7B

Pre-flop

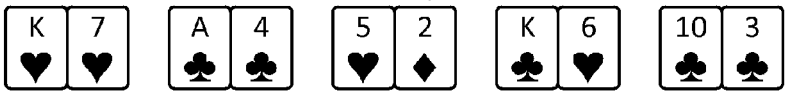

21% 28% 15% 21% 15%

FIG. 8A

Community Cards Hand 1

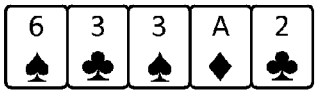

FIG. 8B

| | | Hand 1 | Hand 2 | Hand 3 | Hand 4 | Hand 5 | Total | Rest of Hands |
|---|---|---|---|---|---|---|---|---|
| pre-flop | Player 1 | 21% | 2% | 60% | 10% | 7% | 100% | X% |
| post-flop | Player 1 | 100% | 4th | 2nd | 5th | 3rd | X% | 480% |
| pre-flop | Player 2 | 28% | 6% | 7% | 21% | 38% | 100% | X% |
| post-flop | Player 2 | 3rd | 2nd | 100% | 4th | 5th | X% | 480% |
| pre-flop | Player 3 | 15% | 24% | 15% | 39% | 7% | 100% | X% |
| post-flop | Player 3 | 4th | 100% | 5th | 3rd | 2nd | X% | 480% |
| pre-flop | Player 4 | 21% | 58% | 11% | 5% | 5% | 100% | X% |
| post-flop | Player 4 | 2nd | 5th | 3rd | 100% | 4th | X% | 480% |
| pre-flop | Player 5 | 15% | 10% | 7% | 25% | 43% | 100% | X% |
| post-flop | Player 5 | 5th | 3rd | 4th | 2nd | 100% | X% | 480% |

Hand 1

-The hole cards are dealt to match the percentage assigned (chart) to the first pre-flop hand.
-The highest percentage for this entire hand has also been set (player 1).
-Based on the current percentages, player 2 should call since he/she has the highest percentages. The other players are not expected to call. The percentages determines who would call/bet or not.
-Player 2 would not get a point if he/she calls and wins the hand. However, if player 2 folds here, player 2 will be deducted one point. If player 2 loses this hand, he/she will be deducted a point.
-Each chip bet counts for a decimal point (.01). These are accumulated until the end of the hand. The player who wins gets this accumulated points, and the player who loses hand, loses (gets punished) these accumulated points.

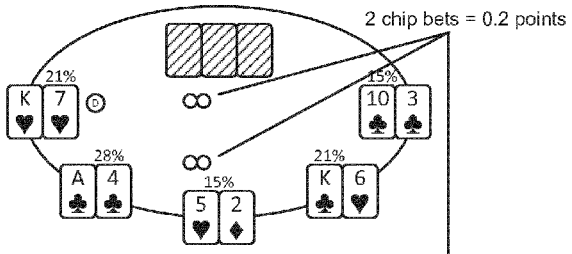

| Highest % Hand | Hand 1 | Pre-Flop | Should Bet? | Action | Points if Win | Points if Loss | Bet | Bet Points | If Loss |
|---|---|---|---|---|---|---|---|---|---|
| * | P1 | 21% | No | Call | 1 | -1 | 2 | 0.2 | -0.2 |
| | P2 | 28% | Yes | Call | 0 | -1 | 2 | 0.2 | -0.2 |
| | P3 | 15% | No | Fold | -- | -- | -- | -- | |
| | P4 | 21% | No | Fold | -- | -- | -- | -- | |
| | P5 | 15% | No | Fold | -- | -- | -- | -- | |
| | Total | 100% | | | | | | | |

Flop

-After the pre-flop, the fist three community cards (Flop) chosen to match the percentages assigned to the hole cards are shown.
-These percentages may not reflect the entire value of each hand to each individual player, but as in chance poker, the percentages fluctuate from the Flop, to the Turn, and only the Rive reveals the true percentage of hole cards and community cards. Here the player with the best percentage of chance of winning the hand would be revealed if still at play (had not folded).
-The same scoring system continues, and all accumulated points are kept until the end of the hand. The two players have accumulated 0.4 in bet points up to this point.

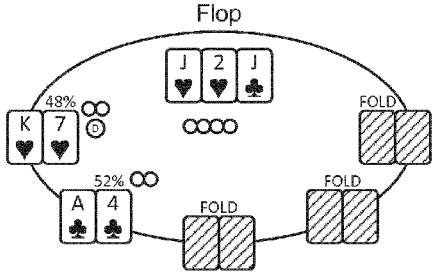

| Flop | Should Bet? | Action | Points if Win | Points if Loss | Bet | Bet Points | If Loss |
|---|---|---|---|---|---|---|---|
| 48% | No | Call | 1 | -1 | 2 | 0.2 | -0.2 |
| 52% | Yes | Call | 0 | -1 | 2 | 0.2 | -0.2 |
| -- | -- | -- | -- | -- | -- | -- | -- |
| -- | -- | -- | -- | -- | -- | -- | -- |
| -- | -- | -- | -- | -- | -- | -- | -- |

FIG. 11A

-The pot remains on the table, and the scoring continues the same.

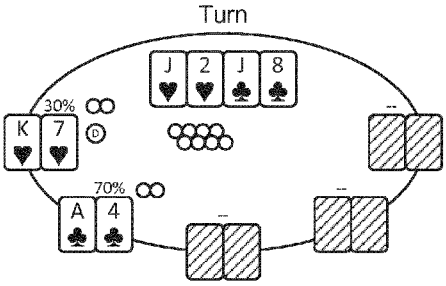

| Turn | Should Bet? | Action | Points if Win | Points if Loss | Bet | Bet Points | If Loss |
|---|---|---|---|---|---|---|---|
| 30% | No | Call | 1 | -1 | 2 | 0.2 | -0.2 |
| 70% | Yes | Call | 0 | -1 | 2 | 0.2 | -0.2 |
| -- | -- | -- | -- | -- | -- | -- | -- |
| -- | -- | -- | -- | -- | -- | -- | -- |
| -- | -- | -- | -- | -- | -- | -- | -- |

-After the river and/or showdown, the winner of the hand is revealed. For this first hand, player 1 wins and gets 3.8 points. Player 2 gets -4.8 points (deducted).
-The cumulative last column keeps track all all points awarded/punished through each hand and keeps a total score fo each player during that play cycle.
-Antes and blinds are not being considered here to keep the scoring simple. Antes are deducted from the chip count of each player, but do not deduct award points alone.

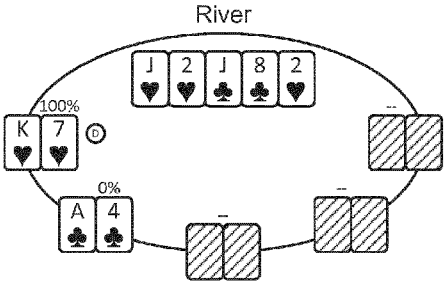

| River | Should Bet? | Action | Points if Win | Points if Loss | Bet | Bet Points | If Loss | Winner | Total Points | Cumu. Score |
|---|---|---|---|---|---|---|---|---|---|---|
| 100% | Yes | Call | 0 | -1 | 2 | 0.2 | -0.2 | * | 3.8 | 3.8 |
| 0% | No | Call | 1 | -1 | 2 | 0.2 | -0.2 | 0 | -4.8 | -4.8 |
| -- | -- | -- | -- | -- | -- | -- | -- | -- | 0 | 0 |
| -- | -- | -- | -- | -- | -- | -- | -- | -- | 0 | 0 |
| -- | -- | -- | -- | -- | -- | -- | -- | -- | 0 | 0 |

FIG. 11B

FIG. 12A

Hand 2

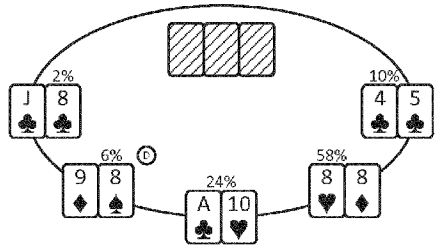

Flop

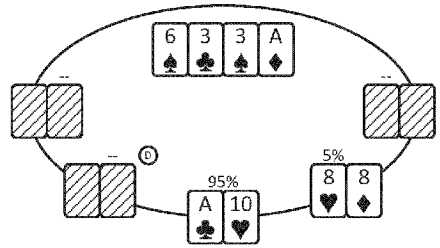

| Highest % Hand | Hand 2 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 2% | No | Fold | -- | -- | -- | -- | -- | -- | -- | -- | -- | -- | -- | -- | -- |
| | P2 | 6% | No | Fold | -- | -- | -- | -- | -- | -- | -- | -- | -- | -- | -- | -- | -- |
| * | P3 | 24% | No | Call | 1 | -1 | 2 | 0.2 | 0.2 | 24% | No | Call | 1 | -1 | 2 | 0.2 | -0.2 |
| | P4 | 58% | Yes | Call | 0 | -1 | 2 | 0.2 | -0.2 | 76% | Yes | Call | 0 | -1 | 2 | 0.2 | 0.2 |
| | P5 | 10% | No | Call | 1 | -1 | 2 | 0.2 | -0.2 | -- | -- | -- | -- | -- | -- | -- | -- |
| | Total | 100% | | | | | | | | | | | | | | | |

Turn

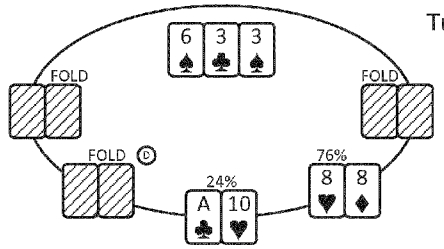

River

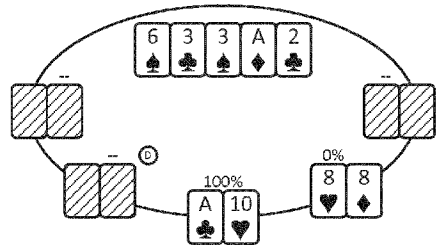

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| -- | -- | -- | -- | -- | -- | -- | -- | -- | -- | -- | -- | -- | -- | -- | -- | -- | 3.8 | 3.8 |
| -- | -- | -- | -- | -- | -- | -- | -- | -- | -- | -- | -- | -- | -- | -- | -- | -- | 0.0 | -4.8 |
| 95% | Yes | Call | 0 | -1 | 2 | 0.2 | -0.2 | 100% | Yes | Call | 0 | -1 | 2 | 0.2 | -0.2 | * | 2.8 | 2.8 |
| 5% | No | Call | 1 | -1 | 2 | 0.2 | -0.2 | 0% | No | Call | 1 | -1 | 2 | 0.2 | -0.2 | -- | -4.4 | -4.4 |
| -- | -- | -- | -- | -- | -- | -- | -- | -- | -- | -- | -- | -- | -- | -- | -- | -- | 0.0 | 0 |

FIG. 12B

Hand 3

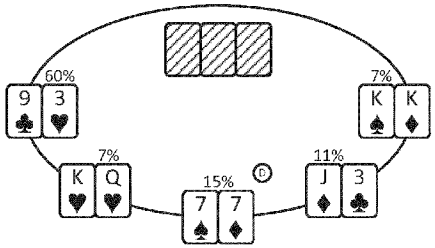

Flop

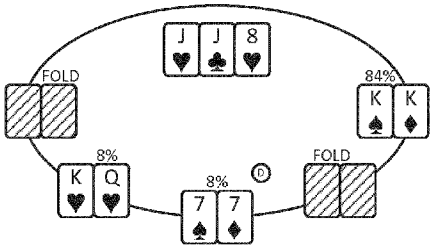

| Highest % Hand | Hand 3 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 60% | Yes | Fold | 0 | -1 | -- | -- | -- | -- | -- | -- | -- | -- | -- | -- | -- |
| * | P2 | 7% | No | Call | 1 | -1 | 2 | 0.2 | -0.2 | 8% | No | Call | 1 | -1 | 2 | 0.2 | -0.2 |
| | P3 | 15% | No | Call | 1 | -1 | 2 | 0.2 | -0.2 | 8% | No | Fold | -- | -- | -- | -- | -- |
| | P4 | 11% | No | Fold | -- | -- | -- | -- | -- | -- | -- | -- | -- | -- | -- | -- | -- |
| | P5 | 7% | No | Call | 1 | -1 | 2 | 0.2 | -0.2 | 84% | Yes | Call | 0 | -1 | 2 | 0.2 | -0.2 |
| | Total | 100% | | | | | | | | | | | | | | | |

Turn

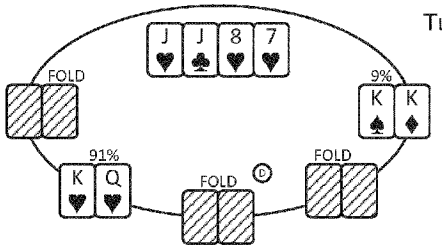

River

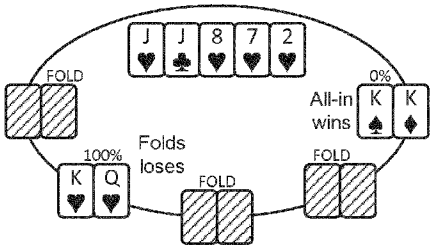

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| -- | -- | -- | -- | -- | -- | -- | -- | -- | -- | -- | -- | -- | -- | 0 | 0 | -- | 3.8 | 3.8 |
| 91% | Yes | Call | 0 | -1 | 2 | 0.2 | -0.2 | 100% | Yes | Fold | 0 | -1 | 2 | 0.2 | -0.2 | -- | -4.8 | -9.6 |
| -- | -- | -- | -- | -- | -- | -- | -- | -- | -- | -- | -- | -- | -- | -- | -- | -- | -1.2 | 1.6 |
| -- | -- | -- | -- | -- | -- | -- | -- | -- | -- | -- | -- | -- | -- | -- | -- | -- | 0.0 | -4.4 |
| 9% | No | Call | 1 | -1 | 2 | 0.2 | -0.2 | 0% | No | All-In | 1 | -1 | 2 | 0.2 | -0.2 | * | 3.8 | 3.8 |

Hand 4

FIG. 13A

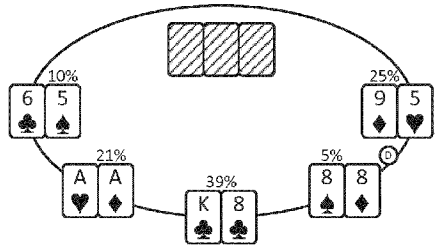

Flop

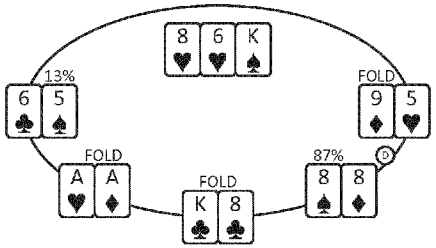

| Highest % Hand | Hand 4 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 10% | No | Call | 1 | -1 | 2 | 0.2 | -0.2 | 13% | No | Call | 1 | -1 | 2 | 0.2 | -0.2 |
| | P2 | 21% | No | Fold | -- | -- | -- | -- | -- | -- | -- | -- | -- | -- | -- | -- | -- |
| | P3 | 39% | Yes | Fold | -- | -1 | -- | -- | -- | -- | -- | -- | -- | -- | -- | -- | -- |
| * | P4 | 5% | No | Call | 1 | -1 | 2 | 0.2 | -0.2 | 87% | Yes | Call | 0 | -1 | 2 | 0.2 | -0.2 |
| | P5 | 25% | No | Fold | -- | -- | -- | -- | -- | -- | -- | -- | -- | -- | -- | -- | -- |
| | Total | 100% | | | | | | | | | | | | | | | |

Turn

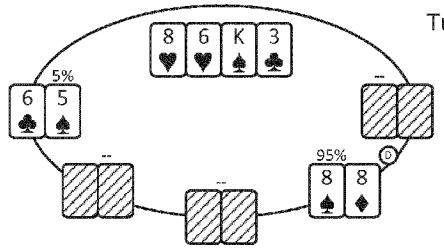

River

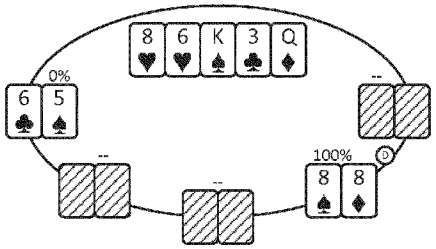

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| 5% | No | Call | 1 | -1 | 2 | 0.2 | -0.2 | 0% | No | Call | 1 | -1 | 2 | 0.2 | -0.2 | -- | -4.8 | -1.0 |
| -- | -- | -- | -- | -- | -- | -- | -- | -- | -- | -- | -- | -- | -- | -- | -- | -- | 0.0 | -9.6 |
| -- | -- | -- | -- | -- | -- | -- | -- | -- | -- | -- | -- | -- | -- | -- | -- | -- | -1 | 0.6 |
| 95% | Yes | Call | 0 | -2 | 2 | 0.2 | -0.2 | 100% | Yes | Call | 0 | -1 | 2 | 0.2 | -0.2 | * | 1.8 | -2.6 |
| -- | -- | -- | -- | -- | -- | -- | -- | -- | -- | -- | -- | -- | -- | -- | -- | -- | 0.0 | 3.8 |

Hand 5

FIG. 13B

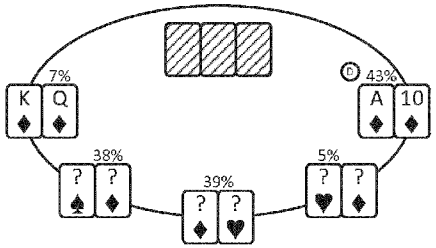

Flop

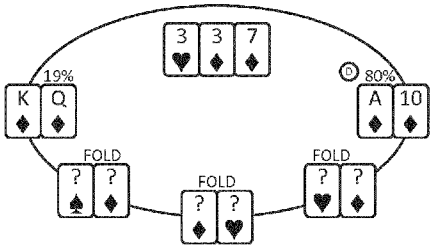

| Highest % Hand | Hand 4 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 7% | No | Call | 1 | -1 | 2 | 0.2 | -0.2 | 19% | No | Call | 1 | -1 | 2 | 0.2 | -0.2 |
| | P2 | 38% | No | Fold | -- | -- | -- | -- | -- | -- | -- | -- | -- | -- | -- | -- | -- |
| | P3 | 7% | No | Fold | -- | -- | -- | -- | -- | -- | -- | -- | -- | -- | -- | -- | -- |
| | P4 | 5% | No | Fold | -- | -- | -- | -- | -- | -- | -- | -- | -- | -- | -- | -- | -- |
| * | P5 | 43% | Yes | Call | 0 | -1 | 2 | 0.2 | -0.2 | 80% | Yes | Call | 0 | -1 | 2 | 0.2 | -0.2 |
| | Total | 100% | | | | | | | | | | | | | | | |

Turn

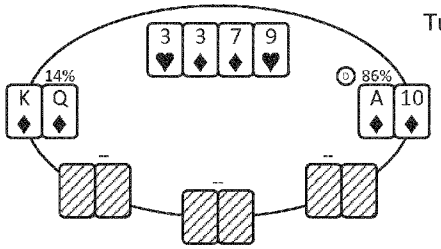

River

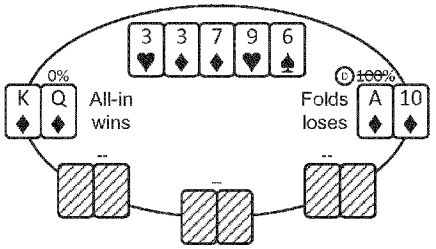

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| 14% | No | Call | 1 | -1 | 2 | 0.2 | -0.2 | 0% | No | All-In | 1 | -1 | 2 | 0.2 | -0.2 | * | 4.8 | 3.8 |
| -- | -- | -- | -- | -- | -- | -- | -- | -- | -- | -- | -- | -- | -- | -- | -- | -- | 0.0 | -9.6 |
| -- | -- | -- | -- | -- | -- | -- | -- | -- | -- | -- | -- | -- | -- | -- | -- | -- | 0.0 | 0.6 |
| -- | -- | -- | -- | -- | -- | -- | -- | -- | -- | -- | -- | -- | -- | -- | -- | -- | 0.0 | -2.6 |
| 86% | Yes | Call | 0 | -1 | 2 | 0.2 | -0.2 | 100% | Yes | Fold | 0 | -1 | 2 | 0.2 | -0.2 | -- | -4.8 | -1 |

| Highest % Hand | Hand 1 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| * | P1 | 21% | No | Call | 1 | -1 | 2 | 0.2 | -0.2 | 48% | No | Call | 1 | -1 | 2 | 0.2 | -0.2 |
| | P2 | 28% | Yes | Call | 0 | -1 | 2 | 0.2 | -0.2 | 52% | Yes | Call | 0 | -1 | 2 | 0.2 | -0.2 |
| | P3 | 15% | No | Fold | -- | -- | -- | -- | -- | -- | -- | -- | -- | -- | -- | -- | -- |
| | P4 | 21% | No | Fold | -- | -- | -- | -- | -- | -- | -- | -- | -- | -- | -- | -- | -- |
| | P5 | 15% | No | Fold | -- | -- | -- | -- | -- | -- | -- | -- | -- | -- | -- | -- | -- |
| | Total | 100% | | | | | | | | | | | | | | | |

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| 30% | No | Call | 1 | -1 | 2 | 0.2 | -0.2 | 100% | Yes | Call | 0 | -1 | 2 | 0.2 | -0.2 | * | 3.8 | 3.8 |
| 70% | Yes | Call | 0 | -1 | 2 | 0.2 | -0.2 | 0% | No | Call | 1 | -1 | 2 | 0.2 | -0.2 | 0 | -4.8 | -4.8 |
| -- | -- | -- | -- | -- | -- | -- | -- | -- | -- | -- | -- | -- | -- | -- | -- | -- | 0 | 0 |
| -- | -- | -- | -- | -- | -- | -- | -- | -- | -- | -- | -- | -- | -- | -- | -- | -- | 0 | 0 |
| -- | -- | -- | -- | -- | -- | -- | -- | -- | -- | -- | -- | -- | -- | -- | -- | -- | 0 | 0 |

| Highest % Hand | Hand 2 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 2% | No | Fold | -- | -- | -- | -- | -- | -- | -- | -- | -- | -- | -- | -- | -- |
| | P2 | 6% | No | Fold | -- | -- | -- | -- | -- | -- | -- | -- | -- | -- | -- | -- | -- |
| * | P3 | 24% | No | Call | 1 | -1 | 2 | 0.2 | 0.2 | 24% | No | Call | 1 | -1 | 2 | 0.2 | -0.2 |
| | P4 | 58% | Yes | Call | 0 | -1 | 2 | 0.2 | -0.2 | 76% | Yes | Call | 0 | -1 | 2 | 0.2 | 0.2 |
| | P5 | 10% | No | Call | 1 | -1 | 2 | 0.2 | -0.2 | -- | -- | -- | -- | -- | -- | -- | -- |
| | Total | 100% | | | | | | | | | | | | | | | |

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| -- | -- | -- | -- | -- | -- | -- | -- | -- | -- | -- | -- | -- | -- | -- | -- | -- | 3.8 | 3.8 |
| -- | -- | -- | -- | -- | -- | -- | -- | -- | -- | -- | -- | -- | -- | -- | -- | -- | 0.0 | -4.8 |
| 95% | Yes | Call | 0 | -1 | 2 | 0.2 | -0.2 | 100% | Yes | Call | 0 | -1 | 2 | 0.2 | -0.2 | * | 2.8 | 2.8 |
| 5% | No | Call | 1 | -1 | 2 | 0.2 | -0.2 | 0% | No | Call | 1 | -1 | 2 | 0.2 | -0.2 | -- | -4.4 | -4.4 |
| -- | -- | -- | -- | -- | -- | -- | -- | -- | -- | -- | -- | -- | -- | -- | -- | -- | 0.0 | 0 |

FIG. 14A

| Highest % Hand | Hand 3 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 60% | Yes | Fold | 0 | -1 | -- | -- | -- | -- | -- | -- | -- | -- | -- | -- | -- |
| * | P2 | 7% | No | Call | 1 | -1 | 2 | 0.2 | -0.2 | 8% | No | Call | 1 | -1 | 2 | 0.2 | -0.2 |
| | P3 | 15% | No | Call | 1 | -1 | 2 | 0.2 | -0.2 | 8% | No | Fold | -- | -- | -- | -- | -- |
| | P4 | 11% | No | Fold | -- | -- | -- | -- | -- | -- | -- | -- | -- | -- | -- | -- | -- |
| | P5 | 7% | No | Call | 1 | -1 | 2 | 0.2 | -0.2 | 84% | Yes | Call | 0 | -1 | 2 | 0.2 | -0.2 |
| | Total | 100% | | | | | | | | | | | | | | | |

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| -- | -- | -- | -- | -- | -- | -- | -- | -- | -- | -- | -- | -- | -- | 0 | 0 | -- | 3.8 | 3.8 |
| 91% | Yes | Call | 0 | -1 | 2 | 0.2 | -0.2 | 100% | Yes | Fold | 0 | -1 | 2 | 0.2 | -0.2 | -- | -4.8 | -9.6 |
| -- | -- | -- | -- | -- | -- | -- | -- | -- | -- | -- | -- | -- | -- | -- | -- | -- | -1.2 | 1.6 |
| -- | -- | -- | -- | -- | -- | -- | -- | -- | -- | -- | -- | -- | -- | -- | -- | -- | 0.0 | -4.4 |
| 9% | No | Call | 1 | -1 | 2 | 0.2 | -0.2 | 0% | No | All-In | 1 | -1 | 2 | 0.2 | -0.2 | * | 3.8 | 3.8 |

| Highest % Hand | Hand 4 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 10% | No | Call | 1 | -1 | 2 | 0.2 | -0.2 | 13% | No | Call | 1 | -1 | 2 | 0.2 | -0.2 |
| | P2 | 21% | No | Fold | -- | -- | -- | -- | -- | -- | -- | -- | -- | -- | -- | -- | -- |
| | P3 | 39% | Yes | Fold | -- | -1 | -- | -- | -- | -- | -- | -- | -- | -- | -- | -- | -- |
| * | P4 | 5% | No | Call | 1 | -1 | 2 | 0.2 | -0.2 | 87% | Yes | Call | 0 | -1 | 2 | 0.2 | -0.2 |
| | P5 | 25% | No | Fold | -- | -- | -- | -- | -- | -- | -- | -- | -- | -- | -- | -- | -- |
| | Total | 100% | | | | | | | | | | | | | | | |

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| 5% | No | Call | 1 | -1 | 2 | 0.2 | -0.2 | 0% | No | Call | 1 | -1 | 2 | 0.2 | -0.2 | -- | -4.8 | -1.0 |
| -- | -- | -- | -- | -- | -- | -- | -- | -- | -- | -- | -- | -- | -- | -- | -- | -- | 0.0 | -9.6 |
| -- | -- | -- | -- | -- | -- | -- | -- | -- | -- | -- | -- | -- | -- | -- | -- | -- | -1 | 0.6 |
| 95% | Yes | Call | 0 | -2 | 2 | 0.2 | -0.2 | 100% | Yes | Call | 0 | -1 | 2 | 0.2 | -0.2 | * | 1.8 | -2.6 |
| -- | -- | -- | -- | -- | -- | -- | -- | -- | -- | -- | -- | -- | -- | -- | -- | -- | 0.0 | 3.8 |

FIG. 14B

| Highest % Hand | Hand 4 | Pre-Flop | Should Bet? | Action | Points if Win | Points if Loss | Bet | Bet Points | If Loss | Flop | Should Bet? | Action | Points if Win | Points if Loss | Bet | Bet Points | If Loss |
|---|---|---|---|---|---|---|---|---|---|---|---|---|---|---|---|---|---|
| | P1 | 7% | No | Call | 1 | -1 | 2 | 0.2 | -0.2 | 19% | No | Call | 1 | -1 | 2 | 0.2 | -0.2 |
| | P2 | 38% | No | Fold | -- | -- | -- | -- | -- | -- | -- | -- | -- | -- | -- | -- | -- |
| | P3 | 7% | No | Fold | -- | -- | -- | -- | -- | -- | -- | -- | -- | -- | -- | -- | -- |
| | P4 | 5% | No | Fold | -- | -- | -- | -- | -- | -- | -- | -- | -- | -- | -- | -- | -- |
| * | P5 | 43% | Yes | Call | 0 | -1 | 2 | 0.2 | -0.2 | 80% | Yes | Call | 0 | -1 | 2 | 0.2 | -0.2 |
| | Total | 100% | | | | | | | | | | | | | | | |

| Turn | Should Bet? | Action | Points if Win | Points if Loss | Bet | Bet Points | If Loss | River | Should Bet? | Action | Points if Win | Points if Loss | Bet | Bet Points | If Loss | Winner | Total Points | Cumu. Score |
|---|---|---|---|---|---|---|---|---|---|---|---|---|---|---|---|---|---|---|
| 14% | No | Call | 1 | -1 | 2 | 0.2 | -0.2 | 0% | No | All-In | 1 | -1 | 2 | 0.2 | -0.2 | * | 4.8 | 3.8 |
| -- | -- | -- | -- | -- | -- | -- | -- | -- | -- | -- | -- | -- | -- | -- | -- | -- | 0.0 | -9.6 |
| -- | -- | -- | -- | -- | -- | -- | -- | -- | -- | -- | -- | -- | -- | -- | -- | -- | 0.0 | 0.6 |
| -- | -- | -- | -- | -- | -- | -- | -- | -- | -- | -- | -- | -- | -- | -- | -- | -- | 0.0 | -2.6 |
| 86% | Yes | Call | 0 | -1 | 2 | 0.2 | -0.2 | 100% | Yes | Fold | 0 | -1 | 2 | 0.2 | -0.2 | -- | -4.8 | -1 |

| Player | Cumul. Score |
|---|---|
| P1 | 3.8 |
| P2 | -9.6 |
| P3 | 0.6 |
| P4 | -2.6 |
| P5 | -1 |

| | |
|---|---|
| Total P1 Round 1 | 18.5 |
| Total P1 Round 2 | 9.6 |
| Total P1 Round 3 | 22.0 |
| Total Play Cycle(PC) | 50.1 |

| | |
|---|---|
| Total PC 1: | 50.1 |
| Total PC N: | 18.5 |
| Total PC N: | 18.5 |
| Total PC 18: | 18.5 |
| Total Avg: | 321 |
| Score P1: | 321 |

(skill level)

After the minimum required play cycles have been played, a score level will be generated. This same score level will allow a player to get a handicap.

FIG. 14C

1501

| Round | Player | Avrg | Gold | Silver | Ranking |
|---|---|---|---|---|---|
| 1 | 1 | 36% | 0 | 0 | 6th |
| | 2 | 36% | ☆ | 0 | 3rd |
| | 3 | 36% | 0 | ☆ | 4th |
| | 4 | 36% | ☆ | ☆ | 2nd |
| | 5 | 36% | ☆ | ☆ | 1st |
| | 6 | 36% | 0 | 0 | 5th |
| Round | Player | Avrg | Gold | Silver | Ranking |
| 2 | 1 | 36% | 0 | 0 | 6th |
| | 2 | 36% | ☆ | 0 | 3rd |
| | 3 | 36% | 0 | ☆ | 4th |
| | 4 | 36% | ☆ | ☆ | 1st |
| | 5 | 36% | ☆ | ☆ | 2nd |
| | 6 | 36% | 0 | 0 | 5th |
| Round | Player | Avrg | Gold | Silver | Ranking |
| 3 | 1 | 36% | 0 | 0 | 6th |
| | 2 | 36% | ☆ | 0 | 3rd |
| | 3 | 36% | 0 | ☆ | 4th |
| | 4 | 36% | ☆ | ☆ | 1st |
| | 5 | 36% | ☆ | ☆ | 2nd |
| | 6 | 36% | 0 | 0 | 5th |

You are #1
National Tournament
World Tournament
Skillup Main
Get More Statistics
Game Card
Get Chips
Bonus
Deals

1502

| Round | Player Hands: | 1 | 2 | 3 | 4 | 5 | 6 | 7 | Total Avg |
|---|---|---|---|---|---|---|---|---|---|
| 1 | Jess | 16% | 6% | 9% | 30% | 12% | 7% | 20% | 100% |
| | Seth | 8% | 11% | 5% | 31% | 10% | 20% | 15% | 100% |
| | John | 6% | 6% | 25% | 10% | 12% | 28% | 31% | 100% |
| | Chris | 10% | 2% | 12% | 26% | 25% | 20% | 5% | 100% |
| | Lina | 12% | 12% | 29% | 6% | 7% | 12% | 22% | 100% |
| | Jaime | 5% | 8% | 25% | 10% | 12% | 10% | 10% | 100% |
| Round | Player | 1 | 2 | 3 | 4 | 5 | 6 | 7 | Total Avg |
| 2 | Jess | 16% | 6% | 9% | 30% | 12% | 7% | 20% | 100% |
| | Seth | 8% | 11% | 5% | 31% | 10% | 20% | 15% | 100% |
| | John | 6% | 6% | 25% | 10% | 12% | 28% | 31% | 100% |
| | Chris | 10% | 2% | 12% | 26% | 25% | 20% | 5% | 100% |
| | Lina | 12% | 12% | 29% | 6% | 7% | 12% | 22% | 100% |
| | Jaime | 5% | 8% | 25% | 10% | 12% | 10% | 10% | 100% |
| Round | Player | 1 | 2 | 3 | 4 | 5 | 6 | 7 | Total Avg |
| 3 | Jess | 16% | 6% | 9% | 30% | 12% | 7% | 20% | 100% |
| | Seth | 8% | 11% | 5% | 31% | 10% | 20% | 15% | 100% |
| | John | 6% | 6% | 25% | 10% | 12% | 28% | 31% | 100% |
| | Chris | 10% | 2% | 12% | 26% | 25% | 20% | 5% | 100% |
| | Lina | 12% | 12% | 29% | 6% | 7% | 12% | 22% | 100% |
| | Jaime | 5% | 8% | 25% | 10% | 12% | 10% | 10% | 100% |

1503

| Round | Hand | Should Have | Did | Earned | | Move |
|---|---|---|---|---|---|---|
| 1 | 1 | Folded | No | 0 | Click Here To See Actual Hands | |
| | 2 | Folded | Yes | 1 | | Best |
| | 3 | Betted | No | 0 | | |
| | 4 | Folded | Yes | 1 | | Skill |
| | 5 | All-In | Yes | 1 | | Skill |
| | 6 | Folded | No | 0 | | |
| Round | Hand | Should Have | Did | Earned | | Move |
| 2 | 1 | All-In | No | 0 | Click Here To See Actual Hands | |
| | 2 | Folded | Yes | 1 | | Best |
| | 3 | Betted | No | 0 | | |
| | 4 | Betted | Yes | 1 | | Skill |
| | 5 | Folded | No | 0 | | |
| | 6 | Folded | No | 0 | | |
| Round | Hand | Should Have | Did | Earned | | Move |
| 3 | 1 | Folded | No | 0 | Click Here To See Actual Hands | |
| | 2 | Folded | Yes | 1 | | Best |
| | 3 | Betted | No | 0 | | |
| | 4 | Folded | Yes | 1 | | Skill |
| | 5 | All-In | Yes | 1 | | Skill |
| | 6 | Folded | No | 0 | | |

You are #1
National Tournament
World Tournament
Skillup Main
Get More Statistics
Game Card
Get Chips
Bonus
Deals

1505

Chris's Game Card
Level 7
Miami Beach, FL
Bank: 250,000
Skilled: 1,600,000
Tour. History
Invite a Friend
Rings
Deals
Redeem
Score: 385
Get Chips/Gifts
Statistics -Hands Played
-Biggest Win
-Biggest Lost
-Win Ratio
-Best Hand
-Best Bluff

FIG. 15

COMPUTERIZED GAME MANAGEMENT SYSTEMS AND METHODS

BACKGROUND

Poker is one of the most popular games in the world, especially the variation of Texas Hold 'Em poker. Texas Hold 'Em requires a great deal of knowledge (e.g., game logistics, strategies, calculations, etc.), skill (e.g., controlling emotions, reading other players' emotions, bluffing, etc.) and, in some cases, a great deal of luck to win. Oftentimes, upon the conclusion of a tournament or match, whether informally held amongst a group of friends, at a casino, or as part of a televised event, players, experts and professionals alike are left wondering if the player who won the tournament is really the best and most skilled player from within the pool of participants, or simply just got lucky.

Others have attempted to offer skill play in games of chance, such as poker, but have all failed for one reason or another, including U.S. Patent Publication No. 2011/0124397, U.S. Patent Publication No. 2007/0037623, European Patent Publication No. EP1687781, U.S. Pat. No. 7,207,563, European Patent Publication No. EP1592486, European Patent Publication No. EP1937377, U.S. Patent Publication No. 2005/0173862, U.S. Pat. No. 7,104,542, U.S. Patent Publication No. 2012/0264496, U.S. Patent Publication No. 2009/0191934, U.S. Patent Publication No. 2008/0248851.

SUMMARY

One implementation of the present disclosure is a game management system. The game management system includes a communications interface configured to receive data inputs from a plurality of client devices. The data inputs include requests to participate as a player in a play cycle of a computerized game. The play cycle include a plurality of hands, each of which includes a first segment and a second segment. The game management system further includes a winning percent module configured to generate a first set of winning percentages defining each player's likelihood of winning each hand of the play cycle during the first segment. The winning percent module generates the first set of winning percentages such that each player has substantially the same cumulative winning percentage across all of the hands of the play cycle during the first segment. The game management system further includes a dealer module configured to select, for each hand of the play cycle, a set of hole cards to be dealt to each player during the first segment. The dealer module selects the set of hole cards based on each player's likelihood of winning the hand as defined by the first set of winning percentages. The game management system further includes a game play module configured to generate a graphical user interface for each player and to provide the graphical user interfaces to the plurality of client devices for display. The graphical user interface for each player includes display data representing the hole cards dealt to the player.

In some embodiments, the winning percent module is configured to generate second set of winning percentages defining each player's likelihood of winning each hand of the play cycle during the second segment. The winning percent module may generate the second set of winning percentages such that each player has substantially the same cumulative winning percentage across all of the hands of the play cycle during the second segment. In some embodiments, the dealer module is configured to select, for each hand of the play cycle, a set of community cards to be dealt during the second segment. The dealer module may select the set of community cards based on each player's likelihood of winning the hand as defined by the second set of winning percentages.

In some embodiments, the communications interface is configured to receive data inputs comprising requested game play actions from the plurality of client devices and the game play module is configured to operate the computerized game in accordance with the requested game play actions. In some embodiments, the game management system further includes an action tracker module configured to track the game play actions performed by each player during each segment and to store the tracked actions in a database.

In some embodiments, the game management system includes a scoring module configured to assign points to each player based on the game play actions performed by each player and the player's likelihood of winning the hand at the time the actions are performed, determine a total of the points assigned to each player at an end of the play cycle, and assign a skill value to each player based on the total points assigned to the player and storing the assigned skill value in a database.

In some embodiments, the game management system includes a user management module configured to generate display data comprising the assigned skill values for each of the players and provide the display data comprising the assigned skill values to the plurality of client devices for display.

In some embodiments, the scoring module is configured to determine a handicap value for each player based on the skill value assigned to the player.

In some embodiments, the actions taken by players include at least one of betting, folding, going all-in, winning a hand, and losing a hand.

Another implementation of the present disclosure is a game management system. The game management system includes a communications interface configured to receive data inputs from a plurality of client devices. The data inputs include requests to participate as a player in a play cycle of a computerized game. The play cycle includes a plurality of hands, each of which includes a first segment and a second segment. The game management system further includes a dealer module configured to select a set of cards to be dealt to each player for each hand of the play cycle, a game play module configured to determine each player's likelihood of winning each hand during the first segment and the second segment based on the set of cards dealt to the player, an action tracker module configured to track game play actions performed by each player during each segment and to store the tracked actions in a database, and a scoring module configured to assign points to each player based on the game play actions performed by each player and the player's likelihood of winning the hand at the time the actions are performed.

In some embodiments, the scoring module is configured to determine a total number of points assigned to each player during the play cycle and a total likelihood of winning for each player during the play cycle.

In some embodiments, the game management system includes a user management module configured to generate a graphical user interface for each player. The graphical user interface may include display data representing at least one of a skill value and a luck value. The skill value may be based on the total number of points assigned to the player and the luck value may be based on the total likelihood of winning determined for the player. The user management module may provide the generated graphical user interfaces to the plurality of client devices for display.

In some embodiments, the scoring module is configured to determine a handicap value for each player based on the skill value assigned to the player.

Another implementation of the present disclosure is a method for operating a computerized game management system. The method includes receiving, at a communications interface of the game management system, data inputs from a plurality of client devices. The data inputs include requests to participate as a player in a play cycle of a computerized game. The play cycle includes a plurality of hands, each of which includes a first segment and a second segment. The method further includes generating, by a winning percent module of the game management system, a first set of winning percentages defining each player's likelihood of winning each hand of the play cycle during the first segment. The winning percent module generates the first set of winning percentages such that each player has substantially the same cumulative winning percentage across all of the hands of the play cycle during the first segment. The method further includes selecting, by a dealer module of the game management system for each hand of the play cycle, a set of hole cards to be dealt to each player during the first segment. The dealer module selects the set of hole cards based on each player's likelihood of winning the hand as defined by the first set of winning percentages. The method further includes generating, by a game play module of the game management system, a graphical user interface for each player. The graphical user interface includes display data representing the hole cards dealt to the player. The method further includes providing, by the game play module, the generated graphical user interfaces to the plurality of client devices for display.

In some embodiments, the method includes generating, by the winning percent module, a second set of winning percentages defining each player's likelihood of winning each hand of the play cycle during the second segment. The winning percent module may generate the second set of winning percentages such that each player has substantially the same cumulative winning percentage across all of the hands of the play cycle during the second segment. In some embodiments, the method includes selecting, by the dealer module for each hand of the play cycle, a set of community cards to be dealt during the second segment. The dealer module may select the set of community cards based on each player's likelihood of winning the hand as defined by the second set of winning percentages.

In some embodiments, the method includes receiving, at the communications interface, data inputs comprising requested game play actions from the plurality of client devices. The method may include operating, by the game play module, the computerized game in accordance with the requested game play actions and tracking, by an action tracker module of the game management system, the game play actions performed by each player during each segment and storing the tracked actions in a database.

In some embodiments, the method includes assigning, by a scoring module of the game management system, points to each player based on the game play actions performed by each player and the player's likelihood of winning the hand at the time the actions are performed. The method may include determining, by the scoring module, a total of the points assigned to each player at an end of the play cycle and assigning, by the scoring module, a skill value to each player based on the total points assigned to the player and storing the assigned skill value in a database.

In some embodiments, the method includes generating display data comprising the assigned skill values for each of the players and providing the display data comprising the assigned skill values to the plurality of client devices for display.

In some embodiments, the method includes determining, by the scoring module, a handicap value for each player based on the skill value assigned to the player.

Another implementation of the present disclosure is a method for operating a computerized game management system. The method includes receiving, at a communications interface of the game management system, data inputs from a plurality of client devices. The data inputs include requests to participate as a player in a play cycle of a computerized game. The play cycle includes a plurality of hands, each of which includes a first segment and a second segment. The method further includes selecting, by a dealer module of the game management system, a set of cards to be dealt to each player for each hand of the play cycle. The method further includes determining, by a game play module of the game management system, each player's likelihood of winning each hand during the first segment and the second segment based on the set of cards dealt to the player. The method further includes tracking, by an action tracker module of the game management system, game play actions performed by each player during each segment and storing the tracked actions in a database and assigning, by a scoring module of the game management system, points to each player based on the game play actions performed by each player and the player's likelihood of winning the hand at the time the actions are performed.

In some embodiments, the method includes determining, by the scoring module, a total number of points assigned to each player during the play cycle and determining, by the scoring module, a total likelihood of winning for each player during the play cycle.

In some embodiments, the method includes generating, by a user management module of the game management system, a graphical user interface for each player. The graphical user interface may include display data representing at least one of a skill value and a luck value. The skill value may be based on the total number of points assigned to the player and the luck value may be based on the total likelihood of winning determined for the player. In some embodiments, the method includes providing, by the user management module, the generated graphical user interfaces to the plurality of client devices for display.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 5 is an illustration of a scoring table according to one embodiment.

FIG. 7B is an illustration of pre-flop and post-flop percentages according to one embodiment.

FIG. 8A is an illustration of pre-flop winning percentages according to one embodiment.

FIG. 8B is an illustration of post-flop community cards according to one embodiment.

FIGS. 11A-13B are illustrations of play cycles processes and winning percentages according to various embodiments.

FIGS. 14A-C are illustrations of a scoring table according to another embodiment.

FIG. 15 is illustrations of statistics and profile pages according to exemplary embodiments.

DETAILED DESCRIPTION

Figure 1A:
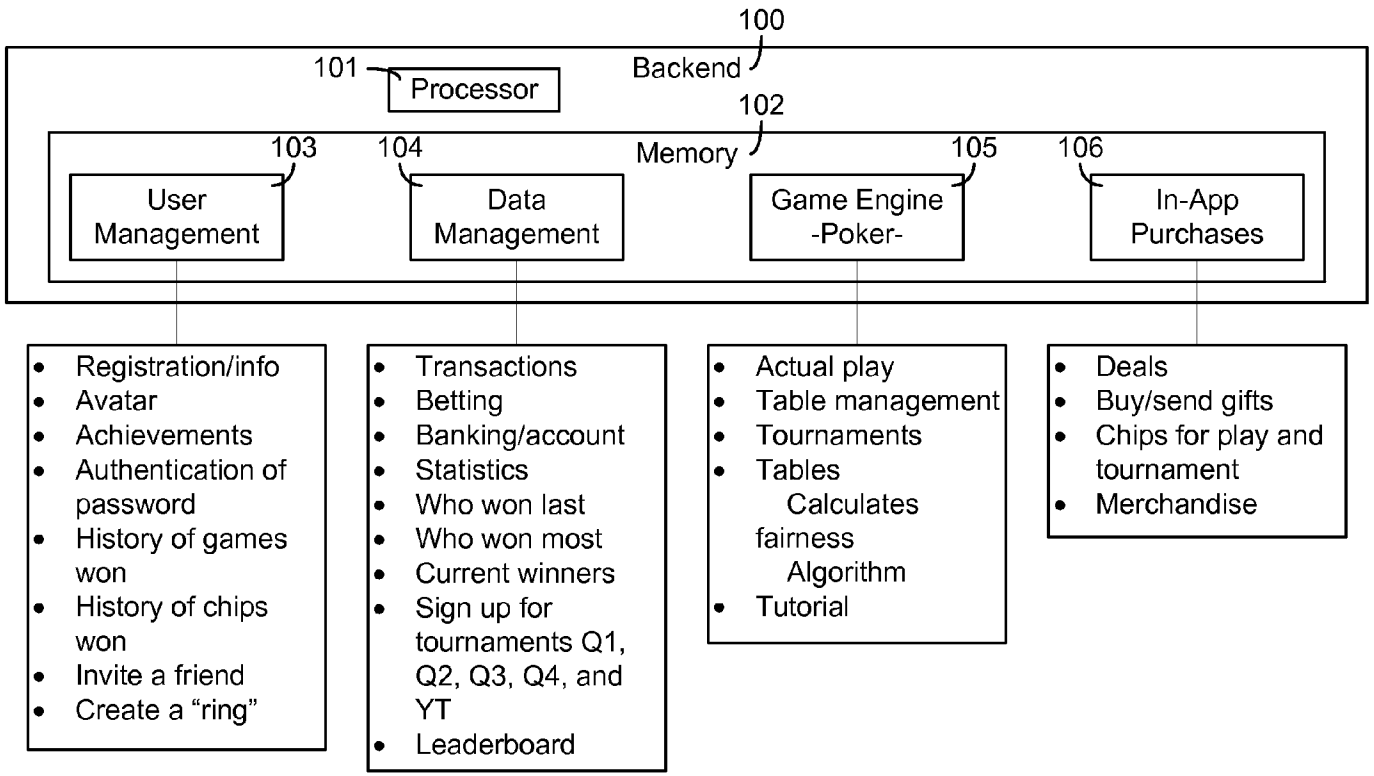
FIG. 1A is a diagram of a system for removing chance from a poker game and generating the skill level of a player according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, computerized game management systems and methods, including systems and methods for removing chance from poker and generating the skill level of a player, are shown according to various embodiments. The systems, methods, and processes described herein provide players an ability to play a game they are familiar with in a way where chance is eliminated and player actions are collected, measured, and stored so that an accurate score (i.e., skill level) can be generated using a scoring algorithm. Therefore, the systems, methods, and processes disclosed herein offer a fair and just way to play games of chance, specifically Texas Hold 'Em style poker. Information regarding each player is collected, including information about the player and the actions or moves each player makes during gameplay. Based on information collected from players, statistics are generated and displayed. The collected information and displayed statistics may include logistics from play cycles played, skill levels of each player, amount of chips or money earned, number of play cycles played, most wins, best hand, average score per hand, average score per play cycle, worst mistake, and players most commonly played with. In some embodiments, the systems, methods, and processes described herein provide a game with no luck or chance in which all players would tie if all players were of the exact same skill level, and all players had the same thinking and decision-making process.

In one embodiment, a system for removing chance from a poker game and generating the skill level of a player is designed for online Texas Hold 'Em poker. The system is implemented on a server and includes a network of computers and mobile devices connected to the Internet. The system utilizes a mathematical calculation during two specific segments of each hand of a poker game. The calculations level the playing field and substantially eliminate chance from the game without altering the feel, strategy, and/or flow of the game itself. The percentages of each player winning a game of poker are leveled, thereby turning what is typically a game of chance into a game of skill. In some embodiments, the system tracks, computes, and stores every action of each player (e.g., bet, fold, all-in, win, loss, etc.). Accordingly, each action is associated with a reward or punishment. An accumulation of each reward and punishment provides a final score at the end of each play cycle. The final score reflects the true skill level of the player.

Referring to FIG. 1A, a diagram of a system for removing chance from a poker game and generating the skill level of a player is shown according to one embodiment. The system includes a backend 100. The backend 100 includes a processor 101 and a memory 102. The memory 102 includes a user management module 103, a data management module 104, a game engine module 105, and an in-app purchase module 106 (otherwise referred to as an "in-game purchase module"). In some embodiments, the system includes a server, a communication system such as the internet, and a network of electronic devices to facilitate communications between players. The electronic devices may be a computer system, a mobile device, a smartphone, a personal digital assistant, tablet computer, smartwatch, electronic gaming machine, etc. The devices may communicate over wired networks and wireless networks alike, such as Bluetooth, low energy Bluetooth, hypersonic communications, Wi-Fi, cellular 3G, 4G, GSM, LiFi, etc.

The system, including each module of the system, may include a computer system (e.g., one or more servers each with one or more processing circuits), each including a processor and memory. The processors may be implemented as microprocessors, application specific integrated circuits (ASICs), one or more field programmable gate arrays (FPGAs), a group of processing components, or other suitable electronic processing components. The memory may be one or more devices (e.g., RAM, ROM, Flash memory, hard disk storage, etc.) for storing data and/or computer code for completing and/or facilitating the various processes described herein. The memory may be or include non-transient volatile memory, non-volatile memory, and non-transitory computer storage media. The memory may include data base components, object code components, script components, or any other type of information structure for supporting the various activities and information structures described herein. The memory may be communicably connected to the processor and include computer code or instructions for executing one or more processes described herein.

In some embodiments, the user management module 103 includes logic that collets, sends, provides, calculates, or stores data relating to registration information, avatars, achievements, password authentication, history of games won, history of chips won, invites to friends, a creation center (including an ability to create custom trophies or rings). In some embodiments, the data management module 104 includes logic that collets, sends, provides, calculates, or stores data relating to transactions, betting, banking, accounting, statistics (including player statistics), winning percentages, records, current winners, leaderboards, and tournament signups. In some embodiments, the game engine module 105 includes logic that collets, sends, provides, calculates, or stores data relating to actual play, table management, tournaments, table calculations, algorithms, fairness determinations, and tutorials. In some embodiments, the in-app purchase module 106 includes logic that collets, sends, provides, calculates, or stores data relating to deals, coupons, purchases (including gifts to other players), purchasing chips for play, purchasing chips for tournament play, purchasing tournament seats, and merchandise.

Figure 1B:
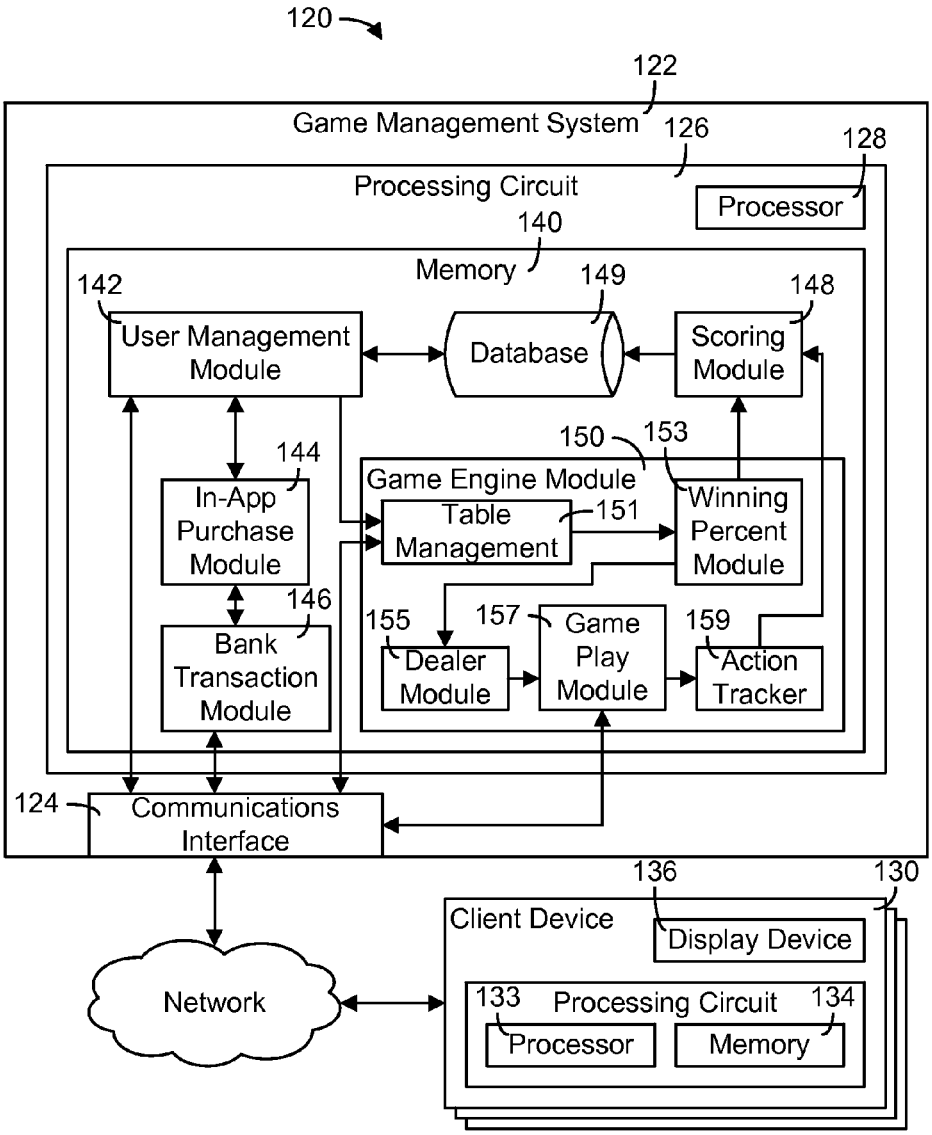
FIG. 1B is a block diagram of a system for removing chance from a poker game and generating the skill level of a player including a game management system according to an exemplary embodiment.

Referring to FIG. 1B, a block diagram of a system 120 for removing chance from a poker game and generating the skill level of a player including a game management system is shown according to an exemplary embodiment. The system 120 is shown to include a game management system 122, and a plurality of client devices 130. In some embodiments, the game management system 122 is configured to receive and send inputs and outputs to and from client devices 130 via a network. The plurality of client devices 130 may be any number of computer devices configured to communicate with game management system 122. For example, the plurality of client devices 130 may include bank computer systems for facilitating transactions, advertisement computer systems for providing advertisements, and personal computer systems for poker players to access game management system 122, for example, to play poker or to manage their account. In some embodiments, client devices 130 include a processing circuit 132, including a processor 133 and memory 134, and a display device 136.

Game management system 122 is shown to include a communications interface 124 and a processing circuit 126. Communications interface 124 may include wired or wireless interfaces (e.g., jacks, antennas, transmitters, receivers, transceivers, wire terminals, etc.) for conducting data communications with various systems, devices, or networks. For example, communications interface 124 may include an Ethernet card and port for sending and receiving data via an Ethernet-based communications network and/or a WiFi transceiver for communicating via a wireless communications network. Communications interface 124 may be configured to communicate via local area networks or wide area networks (e.g., the Internet, a building WAN, etc.) and may use a variety of communications protocols (e.g., BACnet, IP, LON, etc.).

Communications interface 124 may be a network interface configured to facilitate electronic data communications between game management system 122 and various external systems or devices (e.g., client devices 130, etc.). For example, game management system 122 may receive information from client devices 130 indicating that a poker player is ready to play a game of poker, deposit funds, view statistics, etc. Communications interface 124 may receive inputs from client devices 130 via communication interface 124 and game management system 122 may provide inputs or control client devices via communication interface 124.

Still referring to FIG. 1B, processing circuit 126 is shown to include a processor 128 and memory 140. Processor 128 may be a general purpose or specific purpose processor, an application specific integrated circuit (ASIC), one or more field programmable gate arrays (FPGAs), a group of processing components, or other suitable processing components. Processor 128 may be configured to execute computer code or instructions stored in memory 140 or received from other computer readable media (e.g., CDROM, network storage, a remote server, etc.).

Memory 140 may include one or more devices (e.g., memory units, memory devices, storage devices, etc.) for storing data and/or computer code for completing and/or facilitating the various processes described in the present disclosure. Memory 140 may include random access memory (RAM), read-only memory (ROM), hard drive storage, temporary storage, non-volatile memory, flash memory, optical memory, or any other suitable memory for storing software objects and/or computer instructions. Memory 140 may include database components, object code components, script components, or any other type of information structure for supporting the various activities and information structures described in the present disclosure. Memory 140 may be communicably connected to processor 128 via processing circuit 126 and may include computer code for executing (e.g., by processor 128) one or more processes described herein.

Still referring to FIG. 1B, memory 140 is shown to include a user management module 142, an in-app purchase module 144, a bank transaction module 146, a scoring module 148, a database module 149, and a game engine module 150. In some embodiments, memory 140 may not include all modules depicted in FIG. 1B, or memory 140 may include additional modules not shown.

In some embodiments, user management module 142 may function similarly to or the same as user management module 103. User management module 142 may send and receive inputs to and from client devices 130. For example, user management module 142 may determine, and communicate to a user via client device 130, the number of games currently in play and the number of tables with open seats so that the user may select a table to join and begin play. User management module 142 may receive and provide inputs to in-app purchase module 144. In some embodiments, user management module 142 may provide inputs to in-app purchase module 144 in order to facilitate transactions. For example, in-app purchase module 144 may enable a user to purchase chips, tournament entries, buy or send gifts, and purchase merchandise. In some embodiments, in-app purchase module 144 may receive and provide inputs to bank transaction module 146 to further facilitate the transaction. For example, bank transaction module 146 may communicate via communication interface 124 with a client device 130, such as a bank system, to withdraw or deposit funds from a user's bank account. User management module 142 may manage a user's account by providing inputs to database 149. For example, user management module 142 may cause database 149 to store user settings and user information, such as a user's screen name, friends, picture, and so on. Upon logging in to game management system 122, user management module 142 may cause client device 130 to display information based on data received from database 149. In some embodiments, the user may access a history of games played, results, and statistics stored in database 149 via user management system 142. For example, in one embodiment, upon completion of a play cycle, a user may access their skill level as stored in database 149.

Still referring to FIG. 1B, memory 112 is shown to include game engine module 150. Game engine module 150 is shown to include table management module 151, winning percent module 153, dealer module 155, game play module 157 and action tracker 159. Table management module 151 may be configured to send inputs to user management module 142 to notify users that spots at a table are open or that open seats in a tournament remain. In some embodiments, a user selects a game to join via user management module 142 and is placed at the table by table management module 151. Upon determining that the minimum number of players are present at the table (e.g., a full table, a full table minus one spot, etc.), table management module 151 may determine game play settings. For example, table management module 151 may determine a number of hands to be played in the play cycle and select the number of decks of playing cards based on the number of hands to be played. Table management module 151 may receive inputs from client devices 130 via communication interface 124. For example, table management module may receive requests to leave a table, exit a tournament, or receive inputs based on a user's desired game settings, receive chat messages, and so on. Table management module 151 may send inputs to winning percent module 153 based on game parameters, such as the number of players at the table, the number of hands to be played, the number of decks to be used, and so on.

Still referring to FIG. 1B, game engine module 150 is shown to include winning percent module 153. In some embodiments, winning percent module 153 is configured to receive inputs from table management module 151. Winning percent module 153 is configured to generate a chart of winning percentages for each player. For example, in one embodiment, winning percent module 153 generates, for each player, a first chart of winning percentages for the first segment of each hand of the play cycle indicating each player's likelihood of winning the hand, wherein the cumulative winning percentage for each player during the first segment is substantially the same. In another embodiment, winning percent module 153 generates the first chart of winning percentages for the first segment of each and as well as, for each player, a second chart of winning percentages for the second segment of each hand of the play cycle indicating each player's likelihood of winning the hand, wherein the cumulative winning percentage for each player during the second segment is substantially the same. In this way, winning percent module 153 generates an ordered arrangement of cards to be dealt in such a way as to substantially, or altogether, remove chance from the play cycle such that each player has substantially, or exactly, an equal chance of winning the same number of hands during the play cycle. Winning percent module 153 provides an input to dealer module 155 that instructs dealer module 155 of the order that cards should be dealt during the play cycle. In other embodiments, winning percent module 153 is not included or winning percent module 153 is bypassed, for example, when a typical poker game, containing elements of chance, is desired to be played. In some embodiments, the generated winning percentages may be altered, for example, to provide a particular player a greater overall chance of winning (e.g., a handicapping system).

Still referring to FIG. 1B, game engine module 150 is shown to include dealer module 155. Dealer module 155 is configured to deal cards to each player at a table. In some embodiments, dealer module 155 deals cards based on inputs received from winning percent module 153. For example, in one embodiment, dealer module 155 selects, for each player, a set of hole cards to be dealt in the first segment, wherein the strength of each players' hole cards correspond to each players' first chart of winning percentages. In some embodiments, dealer module 155 also selects a set of community cards to be dealt in the second segment, wherein the strength of each players' hole cards, in combination with the community cards, correspond to each players' second chart of winning percentages. In some embodiments, the charts of winning percentages are created such that the distribution and order of winning percentages randomly vary with each play cycle. Randomly generating the charts of winning percentages, while still maintaining an equal chance of overall chance of winning for each player, enables the system to maintain the uncertainty and unexpectability of regular chance poker. In some embodiments, the charts of winning percentages are created such that the distribution and order of winning percentages are randomly assigned to each player for some hands, and the distribution and order of winning percentages for other hands are determined such that the overall cumulative winning percentages for each player level out over the course of a set of hands. For example, in a twenty-hand play cycle, the first eight hands may be dealt based on randomly generated winning percentages corresponding to the chart of winning percentages (i.e., complete randomness), and the next twelve cards may be dealt based on assigned winning percentages that are calculated based on the winning percentages of each player during the first eight hands such that the overall winning percentages of each player are substantially the same at the end of the twenty-hand play cycle. In some embodiments, other combinations of random-chance hands and calculated-chance hands may be dealt. For example, a random-chance hand may be dealt for every calculated-chance hand, two random-chance hands may be dealt for every calculated-chance hand, etc.

Still referring to FIG. 1B, game engine module 150 is shown to include game play module 157 and action tracker 159. Game play module 157 is configured to receive inputs from dealer module 155 and from users via client devices 130. In some embodiments, game play module 157 causes the current dealt cards to be displayed to players at the table and receives inputs from the players, indicating actions that the players would like to take. For example, users may select to fold, bet, go-all-in, check, etc. Based on inputs received from client devices 130, game play module 157 provides dealer module 155 with inputs so that game play continues. For example, after each player receives hole cards and either bets or folds, game play module 157 may provide an input to dealer module 155 that causes dealer module 155 to transition the hand into a second segment, such as the post-flop segment in which a set of community cards are dealt.

Still referring to FIG. 1B, game engine module 150 is shown to include action tracker 159. In some embodiments, action tracker 159 tracks the actions taken by each player during game play. Actions tracked by action tracker 159 may include betting, folding, going-all-in, and amounts bet (e.g., betting one hundred chips during the pre-flop segment, betting five chips after the river community card is turned, etc.), and so on. Action tracker 159 is configured to provide action tracking data to scoring module 148.

Still referring to FIG. 1B, memory 112 is shown to include scoring module 148. Scoring module 148 may be configured to calculate the score that a user of the game management system 122 is awarded upon completion of a play cycle. In some embodiments, scoring module 148 may be configured to receive inputs from action tracker 159 and winning percent module 153. In some embodiments, scoring module 148 assigns points to each player based on each players' actions (e.g., received from action tracker 159) and based on each players' likelihood of winning the hand when the action was taken (e.g., received from winning percent module 153). Scoring module 148 may then calculate the total points assigned to each player during the play cycle. In some embodiments, scoring module 148 may also be configured to receive inputs from database 149. For example, scoring module 148 may receive a player's previous skill level from database 149 and calculate a new skill level based on the player's previous skill level and based on inputs from action tracker 159 and winning percent module 153. Based on a player's assigned points during the play cycle, scoring module 148 stores the player's skill level to database 149. The player's skill level may then be provided to each player via user management module 142.

Figure 2:
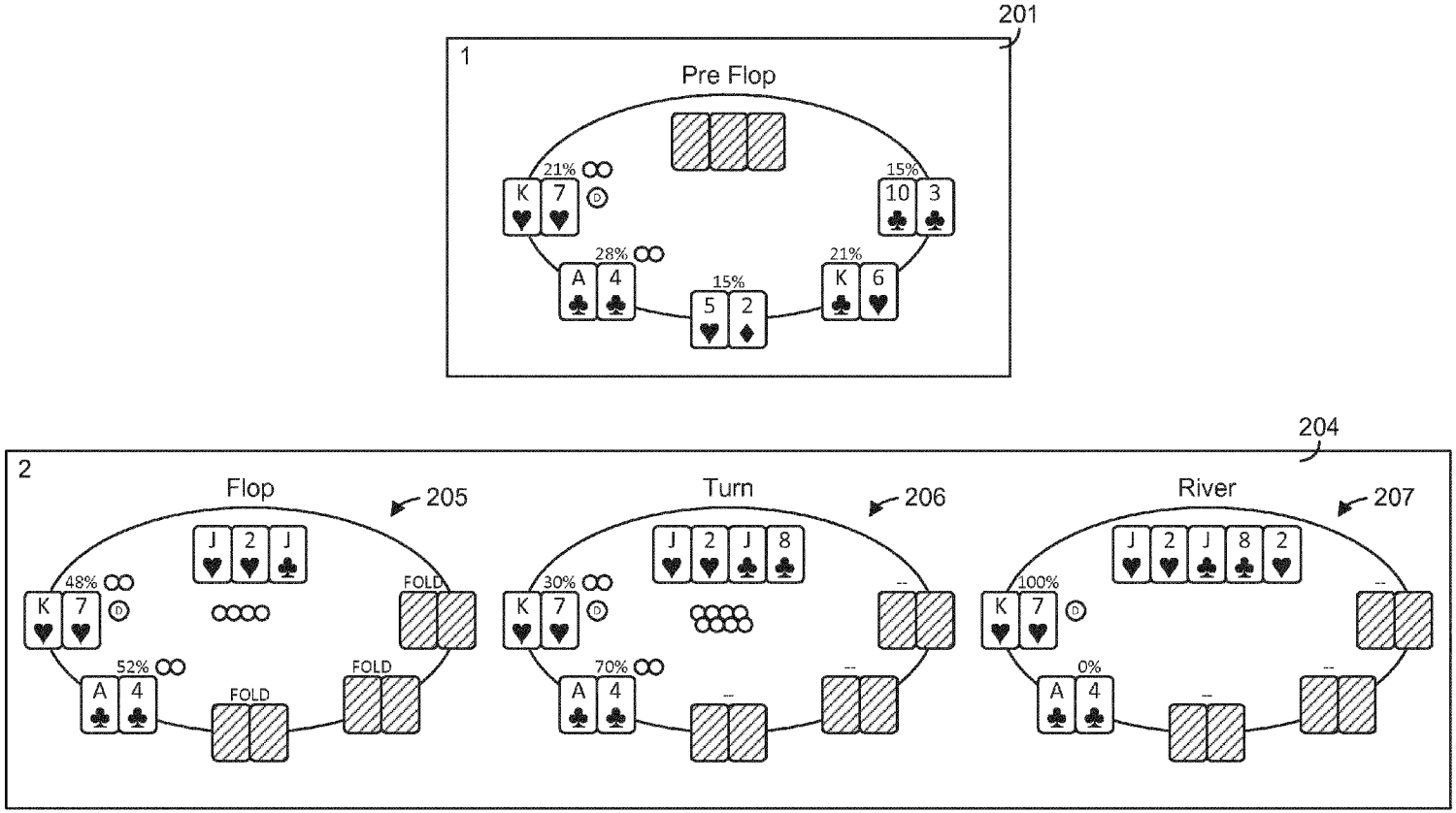
FIG. 2 is an illustration of poker game segments according to one embodiment.

Referring to FIG. 2, an illustration of poker game segments are shown according to one embodiment. In some poker game styles, including Texas Hold 'Em, there are two segments or moments that determine whether a player will most likely fold or bet, including betting all of their chips or money, otherwise known as "going all-in." These segments are the pre-flop segment 201, and the post-flop segment 204, which includes the "Flop" 205, the "Turn" 206 and the "River" 207 segments. As shown in FIG. 2, the Flop consists of dealing three community cards, the Turn consists of dealing of an additional community card for a total of four community cards, and the River consists of dealing yet another community card for a total of five community cards.

Typically, the game does not need to progress to the River 207 segment for the game to end. The game may end at any time upon all players but one folding their hand, thereby dropping out of the current hand leaving the lone remaining player as the winner. The post-flop segment 204 not only usually determines whether a particular player will likely fold, bet, or go all-in, but also usually determines which player will most likely win or lose based on odds or theoretical winning percentages (i.e., percentage chance of winning) The skill of each player can be measured during these two segments.

In some embodiments, the system requires a full play cycle (i.e., a certain number of hands) to be played in order to accurately determine a particular player's skill level. A play cycle may require a different number of hands to be played for games consisting of different numbers of players. In one embodiment, the number of hands played in a full play cycle is one-and-one-third (1.33) times the number of participating players. For example, in one embodiment, a full play cycle for a table with six players requires eight hands to be played per round (6 players×1.33=8 hands). In other embodiments, the number of hands played in a round is greater than one-and-one-third times the number of participating players. In some embodiments, a poker game may commence without a full table or players may drop out of the game during the middle of a play cycle, thus leaving an empty seat and an opportunity for new players to join the already-in-progress game. In this case, the number of hands in the play cycle may be altered to ensure enough hands are played as are needed to equal one-and-one-third times the average number of players present during the course of the game.

Each play cycle includes a number of rounds to be played. A play cycle requires at least one round to be completed but may include several rounds. In one embodiment, a play cycle consists of three rounds. For example, in a game at a six-player table, twenty-four hands will be played because there are three rounds during each play cycle. In some embodiments, the hands to be played in a game with five or fewer players is the same as the hands played at a six-player table. In some embodiments, the maximum number of players per table is ten players with a play cycle of forty hands.

A different number of hands than the number of players in each round with uneven winning percentages for each player ensure that a level of unpredictability is maintained. Maintaining a level of unpredictability prevents players from guessing a pattern of equalization percentages based on which players have had the highest percentage of winning during previous hands. For example, in one embodiment, having eight hands per round at a table with six players would mean that on average each player will or should win at least one hand, and that at least one or two players will or should win at least one additional hand for a total of two (i.e., each of the six players will have at least one winning hand in each eight-hand round, but the players will not be able to accurately predict which players will win the remaining two hands). Dealing hands with uneven winning percentages ensures the system is able to even out the percentages in a more asymmetrical way, therefore not all players will have the same cumulative percentages after each round and predicting who will be dealt the winning hand in a particular hand will be very difficult or impossible. Leveling out the winning percentage for each player over the course of a larger number of hands provides the system more leeway to arrange the order of cards dealt while maintaining the uncertainty of a typical game of poker.

In one embodiment, players are grouped into player tables based on skill level. Next, each player is assigned to a seat at the table. Decks needed for the play cycle are selected, a chart of winning percentages is created (i.e., pre-flop and post-flop winning percentage chance for each player and for each hand), and cards are arranged and organized based on the chart of winning percentages so that cards dealt during a hand correspond to each players' chart of winning percentages. Cards to be dealt to players during the play cycle are determined such that each player has substantially the same cumulative percentage chance of winning the same number of hands at the end of the play cycle. For example, in one embodiment, the winning percentage chance for each player, for each hand, and for each play cycle, is selected (e.g., by selecting the order in which cards will be dealt). For example, the system determines the winning percentage chance assigned to each player during each hand based on the chart while also determining which cards should be dealt to which players based on the winning percentage chance that each player should receive during each particular segment. Accordingly, regardless of the order of play, all players have substantially the same total winning percentage chance at the end of a play cycle. In other words, for each player and for each hand, all pre-flop winning percentage chances and all post-flop winning percentage chances (including the winning percentage chances after the Turn and River) equal the same number at the end of a play cycle. Therefore, all players are assigned a substantially equal cumulative winning percentage for the game.

Figures 3, 4:
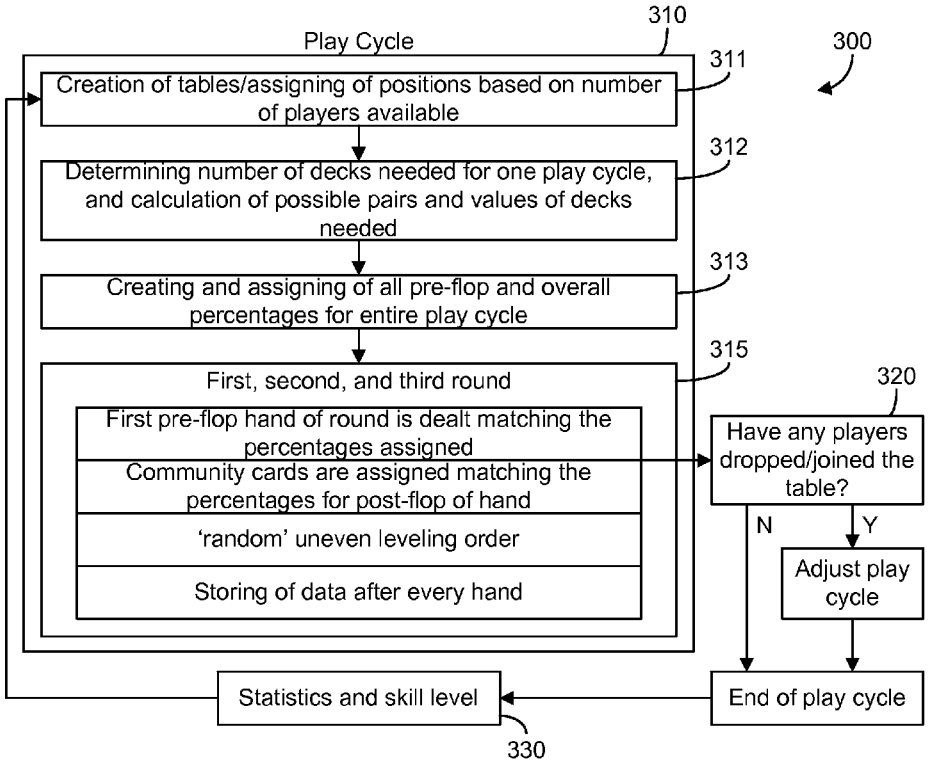
FIG. 3 is a diagram of a method for removing chance from poker and generating the skill level of a player according to one embodiment.
FIG. 4 is an illustration of a points scale for chips betted during a poker game according to one embodiment.

Referring to FIG. 3, a method for removing chance from poker and generating the skill level of a player (300) is shown according to one embodiment. The method includes playing a play cycle (310), determining if any players have left or joined the table (320), and generating statistics and the skill level for each player (330). The play cycle includes a first, second, and third round (315). Upon initiating a play cycle (310), table positions of each player are created and assigned based on the number of players available (311). Next, the number of decks needed to complete a play cycle is determined and possible pairs and values of decks are calculated (312). Next, all pre-flop and overall percentages for the entire play cycle are created and assigned to each player (313). Next, a first, second, and third round of hands are played (315). Each hand includes dealing a pre-flop hand matching the assigned percentages for each player and assigning community cards matching the percentages associated with each post-flop hand. The assigned percentages are randomly distributed throughout the play cycle such that players cannot easily estimate cycles of play or predict who will have the winning hand during any given hand. Next, whether any players have left or joined the table is determined. If any players have left or joined the table, the play cycle is adjusted accordingly. Finally, statistics are calculated and the skill level of each player is determined.

A grading scale is used to measure every action taken by a player and make sure every action is tracked by assigning each action a reward or punishment value. Actions include betting (the value each player bets is also accounted for), folding, going all-in, winning a hand, and losing a hand. In one embodiment, points assigned or deducted are based on the action a player takes, what the player statistically should have done, and the outcome of the hand. For example, when a player bets, and based on his cards should bet, and wins the hand, the player is rewarded with zero points. In another example, when a player bets, and based on his cards should bet, and loses, the player receives a one point deduction. In another example, when a player bets, but based on his cards should not bet, and wins the hand, the player is rewarded with one point. In another example, when a player bets, but based on his cards should not bet, and loses the hand, the player receives a one point deduction. In another example, when a player folds, and based on his cards should fold, the player is rewarded with zero points. In another example, when a player folds, but based on his cards should not fold, the player receives a one point deduction. In this way, a player receives points for doing more than what is expected based on the player's cards and percentage chance of winning the hand; however, the player does not receive points for simply playing as expected.

Referring to FIG. 4, an illustration of a points scale for chips betted during a poker game is shown according to one embodiment. In addition to the player gaining or losing points based on the action the player takes, what the player should have statistically done, and the outcome of the hand, the system also grades the player based on the amount betted. In some embodiments, a scoring system is used if the hand is won. In one embodiment, each chip betted is worth one-tenth of a point. For example, five chips betted during a wining hand is worth half of a point. In another example, ten chips better during a winning hand is worth one point. In some other embodiments, the scoring system may assign a greater number of points for chips betted or weigh the number of chips betted differently during different segments of a hand. It will be appreciated that many different scoring systems and values can be used to score a player's actions, including different values or percentages for the amount of chips won in any given hand. Based on the grading scale and outcome of each hand, each player is awarded a score. In some embodiments, a player's score is, or corresponds with, the player's skill level. In some embodiments, the amount that a player can bet is controlled such that the player is ensured to have enough chips to complete a round or play cycle. For example, the amount of chips a player can bet during any given hand may be limited based on the amount of chips the player has to bet. For example, in one embodiment, a player with one hundred chips to bet may be limited to betting ten chips per hand if there are ten hands remaining in the round or play cycle. The same player, after winning additional chips for a total of one hundred fifty chips, may be limited to betting fifty chips per hand if there are three hands remaining in the round or play cycle. In this way, the player is ensured to have a portion of his chips in all remaining hands of a round or play cycle. In one embodiment, a player may be required to have a retainer or a backup fund of chips to access during a play cycle in case the player runs out of chips before finishing a round or play cycle. In some embodiments, all players are required to have a backup fund of chips in order to enter a tournament.

Figures 6, 7A:
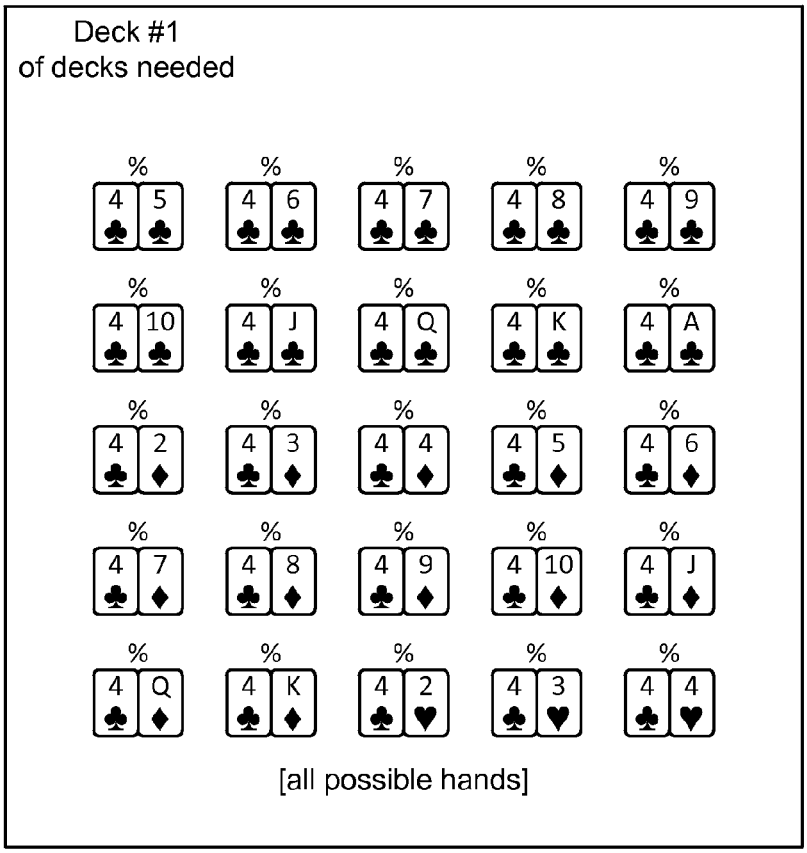
FIG. 6 is an illustration of a scoring table according to another embodiment.
FIG. 7A is an illustration of possible hands of a play cycle according to one embodiment.

Referring to FIGS. 5-6, illustrations of a scoring table is shown according to exemplary embodiments. In some embodiments, the system tracks and stores all data generated by each player after every hand. The data may be stored in a table of percentages, thereby maintaining accurate and updated statistics for all players. Furthermore, adding data generated by each player to a table of percentages ensures each action ever taken by a particular player is considered by the scoring algorithm. Storing data after each hand prevents a loss of data from occurring if a player is dropped from a server and a full play cycle is not finished. Storing data after each hand also prevents a loss of data by a player who willfully leaves the game without finishing a full play cycle. Continuously saving data prevents having to restart an interrupted play cycle, and allows a player to re-enter a table whenever the system can enter the player while keeping most of the previous percentages played after the last full play cycle.

In one embodiment, an invisible empty seat with two cards (and the respective value of the cards) is kept open as a buffer or cushion for when a player joins an ongoing play cycle. The empty seat may also be kept open for when a player voluntarily or involuntarily drops off of a table during a play cycle. For example, a player may drop off of a table if the player's internet connection is lost during a play cycle.

In one embodiment, players are grouped at tables within their same skill level. For example, a player with a skill level of three may be entered in a pool where most other players are also rated level three. In other embodiments, for those who like to challenge themselves, a handicapping system may be used so that players with a low skill can play with higher skilled players and still have a chance of winning A handicap system allows players of different skill levels to compete against each other fairly. For example, handicap systems similar to the ones used in bowling and golf may be implemented. A handicap system attempts to close the skill gap between players of varying skill levels and incentivizes players to challenge themselves against other players of higher skill levels. Accordingly, a handicap system allows players to improve their skills, but also gain bragging rights upon beating a higher skilled player.

In some embodiments, a minimum number of play cycles are required to be played before a handicap is issued (handicap index) for every player, and a maximum gap between skill sets is determined. In some embodiments, the handicap depends on the gap between skill sets. For example, the system may analyze how many extra hands with a highest percentage the player with the lowest skill level will need to have a fair chance against a better player. In another example, providing the less-skilled player two or three extra hands with the highest percentage does not guarantee the player will win. Typically, winning a hand often still requires sufficient skill to win the pot. Therefore, a handicap increases the chances but does guarantee a win. Handicapping systems often allow players to focus more on simply playing the game than obtaining a certain end result.

In some embodiments, a handicap will not interfere nor change the chips won during every hand. The extra hands with a higher winning percent provides a low-skilled player with a handicap a sufficient advantage that provides the player a fair chance to compete and potentially win.

Referring to FIG. 7A, an illustration of the possible hands of a play cycle are shown according to one embodiment. In one embodiment, the system assigns starting positions and determines how many seats each table will have during each play cycle based on the number of players available for a play cycle. The system then determines the number of decks of cards needed for the play cycle and calculates all possible hands from all decks needed for the play cycle. In one embodiment, once the number of players has been determined, the table created, and players assigned to seats at the table, the system creates a chart for each play cycle with all the pre-flop and overall (post-flop) percentages for all hands during that particular play cycle.

Referring to FIG. 7B, an illustration of pre-flop and post-flop percentages are shown according to one embodiment. In one embodiment, the pre-flop and post-flop percentage chart provides the percentage chance of winning that each player will have during every segment of the play cycle, including the percentage chance of winning that each player will have during the pre-flop and post-flop segments of each hand. As shown in FIG. 7B, in some embodiments, during the pre-flop segment, 100% of the chances of winning are spread between each player at the table for each hand of the play cycle. At the end of the play cycle, each player has the same cumulative chance of winning during the pre-flop segment. In some embodiments, during the post-flop segment, each player may not have the same variation of percentages throughout all hands of the play cycle, but has significantly the same cumulative winning percentage during the post-flop segment at the end of the play cycle.

Referring to FIGS. 8A-8B, an illustration of pre-flop winning percentages and post-flop community cards is shown according to one embodiment. Based on this percentage, the system will assign a pair of cards (also known as the hole cards) from the deck to represent the percentage assigned. During this segment, the percentages of the cards are not related, dependent, nor affected by the community cards. The percentages of the two pre-flop cards depend solely on the two cards dealt and the number of cards remaining in the deck. Once the first pre-flop hand is dealt, the system matches a set of community cards to the first pre-flop hand dealt, and to each pre-flop hand of the play cycle thereafter.

Figure 9:
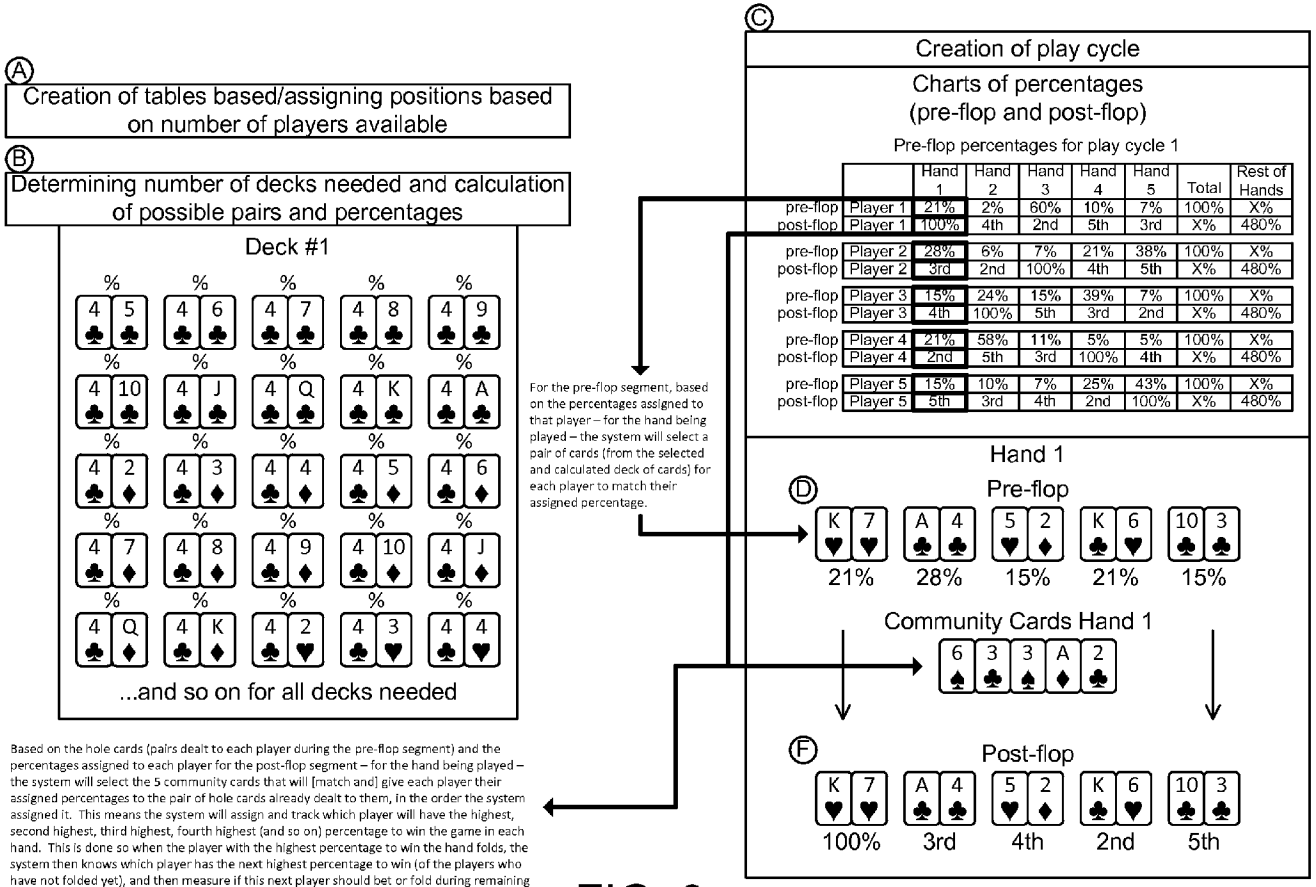
FIG. 9 is a diagram of a method for assigning winning percentages to pre-flop and post-flop hands according to one embodiment.

Referring to FIG. 9, a diagram of a method for assigning winning percentages to pre-flop and post-flop hands is shown according to one embodiment. The set of community cards shown in FIG. 9 provides the hands dealt the equivalent value or percentage assigned for that hand. All pre-flop hands and post-flop hands are associated with a percentage of winning a particular hand (i.e., according to the rank and suit of the cards dealt pre-flop and post-flop). The same cumulative percentage of winning any hand is arranged, calculated, and unevenly assigned to all players such that by end of the play cycle, each player has the same cumulative likelihood of winning Typically, during any given hand, one particular player has the highest chance of winning In some cases, however, multiple players may have an equally highest percentage of winning the hand. In addition, the system accounts for the starting position of each player, and keeps track of the rotation of the starting position. After the first pre-flop hand is dealt and played, the next pre-flop hand will be dealt (hand 2) and so on until the end of the play cycle.

For example, in one embodiment, during the pre-flop segment, the system selects hole cards for each player, from the selected and calculated decks of cards, such that the players' winning percentages match the players' assigned winning percentage. Next, based on the hole cards dealt and the percentages assigned to each player for the post-flop segment, five community cards are dealt such that the community cards match each players' assigned winning percentage to the hole cards dealt in that hand. Also, the system assigns and tracks which player will have the highest, second highest, third highest, fourth highest (and so on) percentage to win each hand. In one embodiment, is the player with the highest percentage to win the hand folds, the system tracks which player has the next highest percentage to win (of the players who have not folded yet), and then determines if the player with the next highest percentage to win should bet or fold during the remaining segments of the current hand. By tracking the percentage chance of winning for each player, the system may accurately assign points to each player based on each players' percentage change of winning and the actions each player took during the remainder of the hand.

Figure 10A:
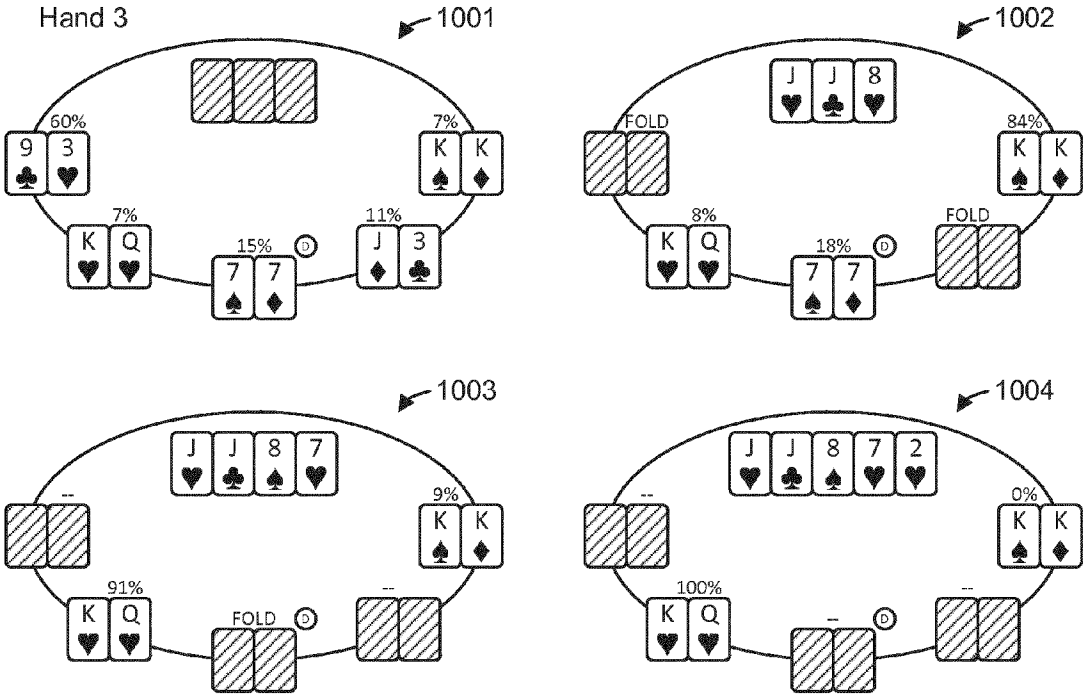
FIG. 10A is an illustration of winning percentages at each stage of a poker hand according to one embodiment.
Figure 10B:
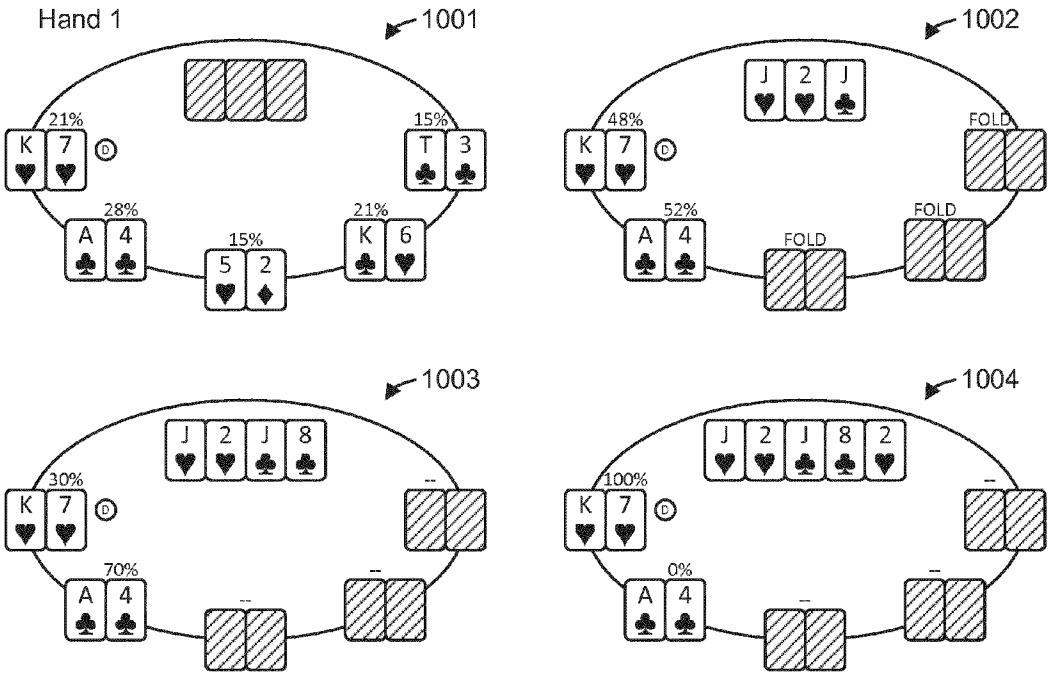
FIG. 10B is an illustration of winning percentages at each stage of a poker hand according to another embodiment.

Referring to FIGS. 10A-10B, illustrations of winning percentages at each stage of a poker hand are shown according to exemplary embodiments. In some embodiments, the winning percentages for each hand and each round are invisible to the players but visible to third parties (e.g., similar to a live televised poker tournament in which winning percentages are not visible to players but visible to an audience). In other embodiments, the winning percentages for each hand and each round are only visible to the players in the statistics section after the play cycle has been completed. The fact that one player is dealt the pre-flop hand 1001, 1011 with the highest winning percentage does not mean that winning percentage is reflected throughout the hand (i.e., during the Flop 1002, 1012, Turn 1003, 1013, and River 1004, 1014). Likewise, the fact that one player is dealt the post-flop hand with the highest winning percentage does not mean that winning percentage is reflected throughout the remaining hand (i.e., during the Turn 1003 and River 1004). When the River card is dealt, the last variation and final percentage is provided to each player. A player with the highest winning percentage does not necessarily win the hand. For example, the player with the highest winning percentage may fold because they do not believe that they in fact do have the highest winning percentage or may fold for other reasons (e.g., another player goes all-in, etc.).

In some embodiments, the scoring system may accumulate points for each individual player throughout a hand and tally the points (either in favor of or against a player) upon the hand being won by a player. For example, a player with the lowest pre-flop winning percentage that bets and causes the other players to fold receives a point in addition to points received for the amount betted. In another example, a player with the lowest pre-flop winning percentage that bets and causes the other players to bet and move on to the post-flop segment receives a point for their play during the pre-flop segment. During the post-flop segment, the player may gain additional points by betting again. Upon the player winning the hand, all the points gained or lost by the player for taking actions (e.g., betting, etc.), including the amount betted during each round, are accumulated in favor of raising the player's skill level. However, if the player loses such a hand, the points the player accumulated are counted against the player's skill level. In some embodiments, a player may be required to play a minimum of ten play cycles before the player's skill level is generated.

In some embodiments, the scoring system may be used to determine the skill of players playing a regular-chance game of poker. In such an embodiment, cards are dealt at random, and the charts of winning percentages do not dictate the order in which cards are dealt during any segment of a hand. For each hand, each players' likelihood of winning during the first segment and the second segment is determined based on the cards dealt to each player. The actions that each player takes during each segment is tracked and points are assigned to the players based on the actions taken by each player and based on each players' likelihood of winning the hand when the action was taken. The total points assigned to each player during the play cycle is calculated, as well as each players' total likelihood of winning Each player may be provided with a skill value and/or an overall luck value. The skill value may be based on each players' total assigned points accumulated during the play cycle. The overall luck value may be based on each players' total likelihood of winning In some embodiments, the skill value and overall luck value may be based on a previous skill value or overall luck value such that a player's skill value and overall luck value may be tracked and calculated based on more than one play cycle (e.g., a set number of games, a season, during a tournament, during a professional career, etc.).

Referring now to FIGS. 11A-13B, illustrations of play cycles and winning percentages are shown according to various embodiments. In one embodiment, once the number of players is set, the number of decks needed for the play cycle is determined, and the table is created, the charts of percentages are assigned, and the first pre-flop hand is dealt. Thereafter, player actions are tracked and points are either gained or lost to determine a winner during each hand.

Referring now to FIGS. 14A-C, illustrations of a scoring table are shown according to exemplary embodiments. FIGS. 14A-C illustrate points accumulated by five different players during a five hand play cycle. After the minimum required play cycles have been played, a score level is generated.

Referring now to FIG. 15, illustrations of scoring tables 1501, 1502, 1503 are shown according to exemplary embodiments. Scoring tables 1501, 1502, 1503 may be displayed after each round of a play cycle so that a player can view their current score and the current score of other players. Various statistics may be displayed, such as average winning percentage, ranking, winning percentages for each hand, winning percentages for each segment of each hand played, recommended actions for each player for each possible action during the play cycle, points earned for each action taken, total cumulative points earned for a full play cycle, each players' "best move" and "worst move" (e.g., according to points won or lost), among other statistics. A game card 1505 may be displayed for each player that includes, for example, a picture of the individual player, the player's geographic location, the level of the player, the amount of chips or credits the player has accumulated, the number of skill points the player has accumulated, a history of games the player participated in, trophies, statistics, opportunities to purchase gifts or buy more chips, among others.

Figure 16:
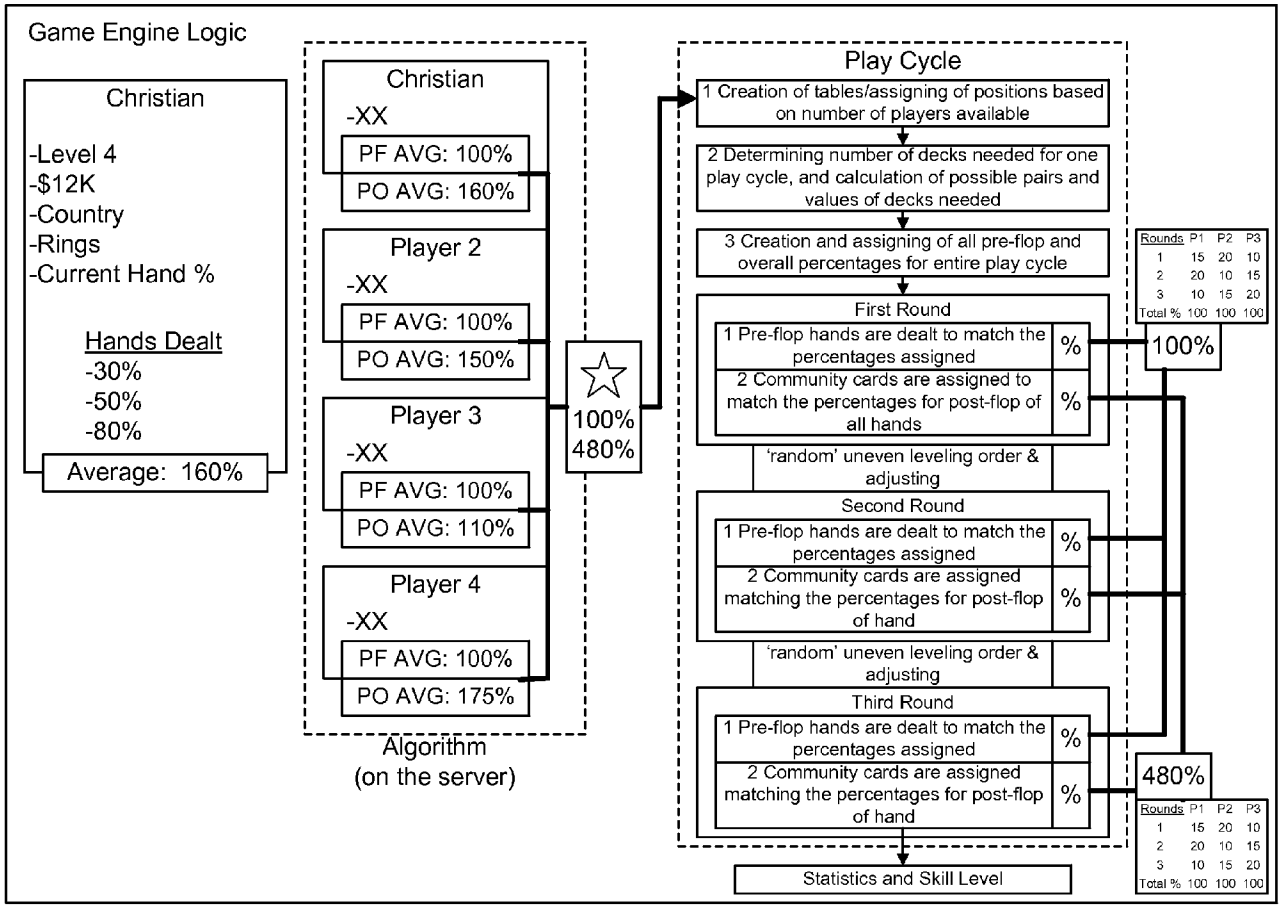
FIGS. 16-17 are diagrams of methods for assigning winning percentages to pre-flop and post-flop hands according to exemplary embodiments.
Figure 17:
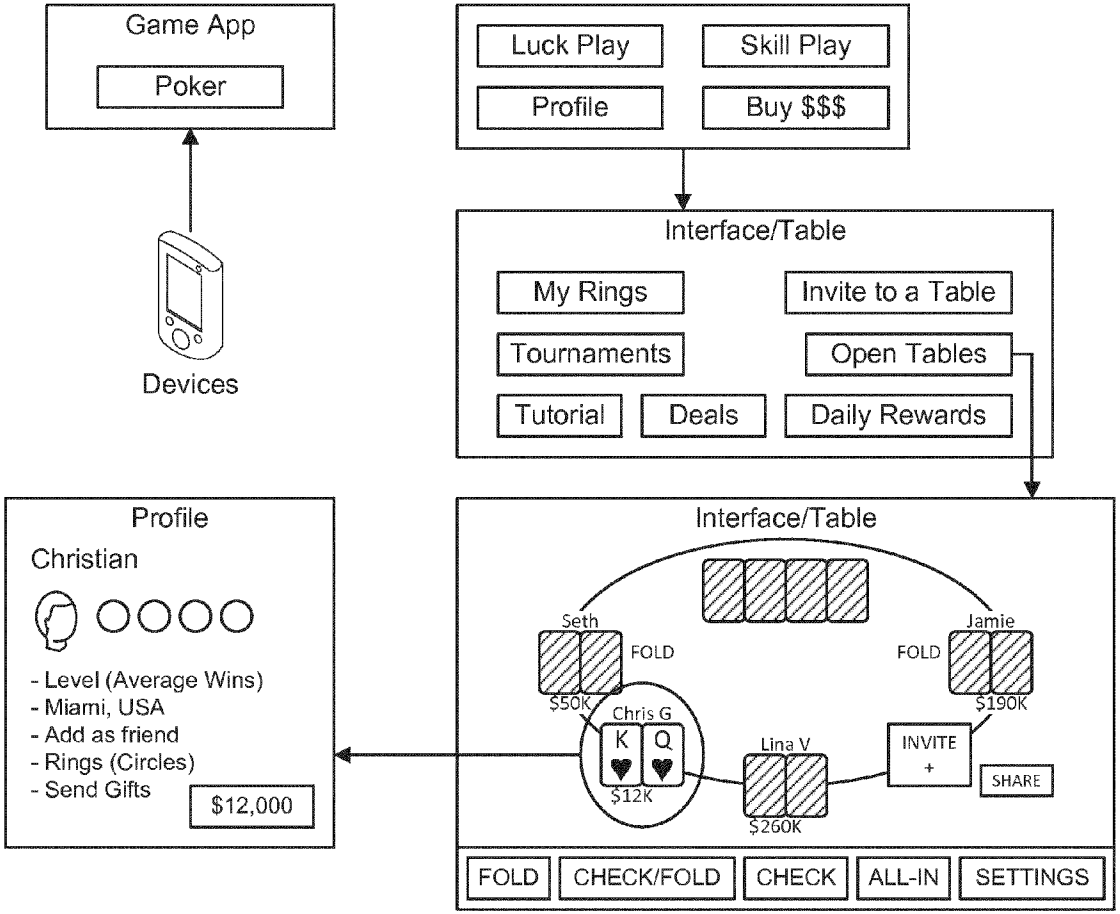

Referring now to FIGS. 16-17, diagrams of methods for assigning winning percentages to pre-flop and post-flop hands are shown according to exemplary embodiments. In some embodiments, players may choose from among different types of gameplay, including regular (or "luck-based") poker, skill-based poker, poker games in which gameplay is effected by a player's handicap (e.g., wherein a handicap determines cards that are dealt, amounts that may be bet, etc.), and so on.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor.

When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A system for at least substantially removing chance from a traditionally chance-based game, the system comprising:

a communications interface configured to receive data inputs from a plurality of client devices, the data inputs comprising requests to participate as a player in a play cycle of a computerized game, wherein the play cycle comprises a plurality of hands, each hand comprising a first segment and a second segment;

a winning percent module configured to generate a first set of winning percentages defining each player's likelihood of winning each hand of the play cycle during the first segment, wherein the winning percent module generates the first set of winning percentages and assigns winning percentages from the generated first set of winning percentages to each player such that the assigned winning percentages provide each player with substantially the same cumulative winning percentage across all of the hands of the play cycle during the first segment;

a dealer module configured to select, for each hand of the play cycle, a set of hole cards to be dealt to each player during the first segment, wherein the dealer module selects the set of hole cards based on each player's likelihood of winning the hand as defined by the first set of winning percentages generated prior to the dealer module selecting the set of hole cards to be dealt to each player; and a game play module configured to generate a graphical user interface for each player and to provide the graphical user interfaces to the plurality of client devices for display, wherein the graphical user interface for each player comprises display data representing the hole cards dealt to the player;

wherein the dealer module is further configured to select the set of hole cards for each player so that a strength of the selected hole cards correspond to the winning percentages assigned to each player from the generated first set of winning percentages such that each player is dealt an ordered arrangement of cards that substantially or altogether removes chance from the play cycle and so that each player has substantially or exactly an equal chance of winning the same number of hands during the play cycle.

2. The system of claim 1, wherein:

the winning percent module is configured to generate second set of winning percentages defining each player's likelihood of winning each hand of the play cycle during the second segment, wherein the winning percent module generates the second set of winning percentages such that each player has substantially the same cumulative winning percentage across all of the hands of the play cycle during the second segment; and the dealer module is configured to select, for each hand of the play cycle, a set of community cards to be dealt during the second segment, wherein the dealer module selects the set of community cards based on each player's likelihood of winning the hand as defined by the second set of winning percentages.

3. The system of claim 1, wherein the communications interface is configured to receive data inputs comprising requested game play actions from the plurality of client devices and the game play module is configured to operate the computerized game in accordance with the requested game play actions; and further comprising an action tracker module configured to track the game play actions performed by each player during each segment and to store the tracked actions in a database.

4. The system of claim 3, further comprising a scoring module configured to:

assign points to each player based on the game play actions performed by each player and the player's likelihood of winning the hand at the time the actions are performed;

determine a total of the points assigned to each player at an end of the play cycle; and assign a skill value to each player based on the total points assigned to the player and storing the assigned skill value in a database.

5. The system of claim 4, further comprising a user management module configured to:

generate display data comprising the assigned skill values for each of the players; and provide the display data comprising the assigned skill values to the plurality of client devices for display.

6. The system of claim 1, wherein the scoring module is configured to determine a handicap value for each player based on the skill value assigned to the player.

7. The system of claim 1, wherein the actions taken by players include at least one of betting, folding, going all-in, winning a hand, and losing a hand.

8. A system for at least substantially removing chance from a traditionally chance-based game, the system comprising:

a communications interface configured to receive data inputs from a plurality of client devices, the data inputs comprising requests to participate as a player in a play cycle of a computerized game, wherein the play cycle comprises a plurality of hands, each hand comprising a first segment and a second segment;

a dealer module configured to select a set of cards to be dealt to each player for each hand of the play cycle;

a game play module configured to determine each player's likelihood of winning each hand during the first segment and the second segment based on the set of cards dealt to the player;

an action tracker module configured to track game play actions performed by each player during each segment and to store the tracked actions in a database; and a scoring module configured to assign points to each player based on the game play actions performed by each player and the player's likelihood of winning the hand at the time the actions are performed;

wherein the dealer module selects the set of cards to be dealt to each player based on a set of predetermined winning percentages assigned to each player, and wherein the set of predetermined winning percentages specify an ordered arrangement of cards to be dealt by the dealer module in such a way as to substantially or altogether remove chance from the play cycle such that each player has substantially or exactly an equal chance of winning the same number of hands during the play cycle.

9. The system of claim 8, wherein the scoring module is configured to determine a total number of points assigned to each player during the play cycle and a total likelihood of winning for each player during the play cycle.

10. The system of claim 9, further comprising a user management module configured to:

generate a graphical user interface for each player, the graphical user interface including display data comprising at least one of a skill value and a luck value, wherein the skill value is based on the total number of points assigned to the player and the luck value is based on the total likelihood of winning determined for the player; and provide the generated graphical user interfaces to the plurality of client devices for display.

11. The system of claim 8, wherein the scoring module is configured to determine a handicap value for each player based on the skill value assigned to the player.

12. A method for operating a computerized system for at least substantially removing chance from a traditionally chance-based game, the method comprising:

receiving, at a communications interface of the system, data inputs from a plurality of client devices, the data inputs comprising requests to participate as a player in a play cycle of a computerized game, wherein the play cycle comprises a plurality of hands, each hand comprising a first segment and a second segment;

generating, by a winning percent module of the system, a first set of winning percentages defining each player's likelihood of winning each hand of the play cycle during the first segment, wherein the winning percent module generates the first set of winning percentages and assigns winning percentages from the generated first set of winning percentages to each player such that the assigned winning percentages provide each player with substantially the same cumulative winning percentage across all of the hands of the play cycle during the first segment;

selecting, by a dealer module of the system for each hand of the play cycle, a set of hole cards to be dealt to each player during the first segment, wherein the dealer module selects the set of hole cards based on each player's likelihood of winning the hand as defined by the first set of winning percentages generated prior to selecting the set of hole cards to be dealt to each player;

generating, by a game play module of the system, a graphical user interface for each player, the graphical user interface comprising display data representing the hole cards dealt to the player; and providing, by the game play module, the generated graphical user interfaces to the plurality of client devices for display;

wherein selecting the set of hole cards for each player includes selecting the set of hole cards so that a strength of the selected hole cards correspond to the winning percentages assigned to each player from the generated first set of winning percentages such that each player is dealt an ordered arrangement of cards that substantially or altogether removes chance from the play cycle and so that each player has substantially or exactly an equal chance of winning the same number of hands during the play cycle.

13. The method of claim 12, further comprising:

generating, by the winning percent module, a second set of winning percentages defining each player's likelihood of winning each hand of the play cycle during the second segment, wherein the winning percent module generates the second set of winning percentages such that each player has substantially the same cumulative winning percentage across all of the hands of the play cycle during the second segment; and selecting, by the dealer module for each hand of the play cycle, a set of community cards to be dealt during the second segment, wherein the dealer module selects the set of community cards based on each player's likelihood of winning the hand as defined by the second set of winning percentages.

14. The method of claim 12, further comprising:

receiving, at the communications interface, data inputs comprising requested game play actions from the plurality of client devices;

operating, by the game play module, the computerized game in accordance with the requested game play actions; and tracking, by an action tracker module of the system, the game play actions performed by each player during each segment and storing the tracked actions in a database.

15. The method of claim 14, further comprising:

assigning, by a scoring module of the system, points to each player based on the game play actions performed by each player and the player's likelihood of winning the hand at the time the actions are performed;

determining, by the scoring module, a total of the points assigned to each player at an end of the play cycle; and assigning, by the scoring module, a skill value to each player based on the total points assigned to the player and storing the assigned skill value in a database.

16. The method of claim 15, further comprising:

generating display data comprising the assigned skill values for each of the players; and providing the display data comprising the assigned skill values to the plurality of client devices for display.

17. The method of claim 12, further comprising:

determining, by the scoring module, a handicap value for each player based on the skill value assigned to the player.

* * * * *